US008754814B2

(12) United States Patent
Rao et al.

(10) Patent No.: US 8,754,814 B2
(45) Date of Patent: Jun. 17, 2014

(54) ANTENNA FOR MULTI MODE MIMO COMMUNICATION IN HANDHELD DEVICES

(75) Inventors: Qinjiang Rao, Waterloo (CA); Dong Wang, Waterloo (CA)

(73) Assignee: BlackBerry Limited, Waterloo (CA)

( * ) Notice: Subject to any disclaimer, the term of this patent is extended or adjusted under 35 U.S.C. 154(b) by 730 days.

(21) Appl. No.: 12/617,763

(22) Filed: Nov. 13, 2009

(65) Prior Publication Data

US 2011/0115677 A1 May 19, 2011

(51) Int. Cl.

| | |
|---|---|
| ***H01Q 1/24*** | (2006.01) |
| ***H01Q 1/38*** | (2006.01) |
| ***H01Q 21/30*** | (2006.01) |
| ***H01Q 9/42*** | (2006.01) |
| ***H01Q 5/00*** | (2006.01) |

(52) U.S. Cl.

CPC ..... *H01Q 21/30* (2013.01); *H01Q 1/243* (2013.01); *H01Q 1/38* (2013.01); *H01Q 9/42* (2013.01); *H01Q 5/0058* (2013.01)

USPC ..... 343/702; 343/700 MS

(58) Field of Classification Search

USPC ..... 343/700 MS, 702

See application file for complete search history.

(56) References Cited

U.S. PATENT DOCUMENTS

| | | | | |
|---|---|---|---|---|
| 6,995,714 | B2 * | 2/2006 | Sim et al. | 343/702 |
| 7,046,197 | B2 * | 5/2006 | Okado | 343/700 MS |
| 7,369,092 | B1 | 5/2008 | Wen et al. | |
| 7,589,687 | B2 * | 9/2009 | Iwai et al. | 343/767 |
| 7,619,571 | B2 * | 11/2009 | Vesterinen | 343/702 |
| 2003/0001781 | A1 | 1/2003 | Konishi | |
| 2004/0125030 | A1 | 7/2004 | Sung et al. | |
| 2004/0130495 | A1 * | 7/2004 | Hilgers | 343/702 |
| 2009/0051595 | A1 | 2/2009 | Rao et al. | |
| 2009/0231214 | A1 * | 9/2009 | Mukouyama | 343/702 |
| 2010/0085258 | A1 * | 4/2010 | Teshima et al. | 343/700 MS |

FOREIGN PATENT DOCUMENTS

| | | | |
|---|---|---|---|
| CA | 2638104 | 9/2008 | |
| CA | 2639203 | 12/2008 | |
| DE | 10049845 | 4/2002 | |
| EP | 1298760 | 4/2003 | |
| JP | 2002-158529 A * | 5/2002 | H01Q 5/01 |
| JP | 2002158529 | 5/2002 | |
| JP | 2005210523 | 8/2005 | |

OTHER PUBLICATIONS

European application No. 09175974.6, Extended European Search Report, dated Mar. 9, 2010.

(Continued)

*Primary Examiner* — Robert Karacsony
(74) *Attorney, Agent, or Firm* — Moffat & Co.

(57) ABSTRACT

A multi-band antenna comprising a dielectric substrate, a ground plane formed on a first area of the dielectric substrate, a radiation part arranged in a second area of the dielectric substrate where the ground surface is not formed, a feed section formed of a metallic trace and having one end connected to the radiation part and an opposite end disposed near an edge of the ground plane for forming a feed point and the radiation part having a pair of monopole antenna elements formed of conductive metallic traces; a first monopole antenna element for radiating at a first resonant frequency, and a second monopole antenna element for radiating at a second resonant frequency and the conductive metallic traces being folded to form a three dimensional structure, with at least a portion of said first monopole spaced from a plane of the substrate and said second monopole.

17 Claims, 32 Drawing Sheets

(56) References Cited

OTHER PUBLICATIONS

U. Navsariwala, M. Schamberger, N. Buris, "Impact of a User on the Performance of MIMO Antenna Systems in Small Wireless Devices", 2008 IEEE International Symposium on Antennas and Propagation and USNC/URSI National Radio Science Meeting. San Diego, Manchester Grand Hyatt, Jul. 5-12, 2008.

Vaughan and J.B. Anderson, "Antenna Diversity in Mobile Communications." IEEE Transactions on Vehicular Technology, vol. VT-36, No. 4, pp. 149-172, Nov. 1987.

PCT application No. PCT/CA2010/001784, Written Opinion, ISA dated Feb. 2, 2011.

PCT application No. PCT/CA2010/001784, International Search Report, ISA dated Feb. 2, 2011.

PCT application No. PCT/CA2010/001784, International Preliminary Report on Patentability dated May 24, 2012.

* cited by examiner

ANTENNA FOR MULTI MODE MIMO COMMUNICATION IN HANDHELD DEVICES

FIELD OF THE DISCLOSURE

The present invention relates to the field of communications systems, and, more particularly, to antennas for mobile wireless communications devices and related methods.

BACKGROUND

Mobile devices are being required to support multiple applications, such as GSM, PSC, UMTS, WLAN, Wibro (Wireless broadband), and Bluetooth, and LTE, which in turn require multiple antennas, since one antenna cannot typically cover the bandwidth requirements of the multiple applications due to the physical limitations of an antenna described in "Physical Limitations of Antennas," IEEE Transactions on Antennas and Propagation, vol. 51, no. 8, pgs. 2116-2123, 2003. As a result, multiple antennas must now share the already limited space within the mobile device.

Furthermore, techniques such as multiple-input multiple-out (MIMO) have emerged, which significantly increase the performance of HSPA (high speed packet access) and LTE (long term evaluation) networks. This is usually accomplished by using multiple antennas arranged to have low correlation between two or more unique radio signals. In large devices, where space is less limited, this is easily accomplished by using spatial diversity (distance between antennas), or somehow by pattern diversity (difference between antenna aiming directions), and polarization diversity together. Unfortunately, the size of mobile wireless communications devices (e.g., cellular devices) continue to decrease and so too does the allowable space for the device antenna. As a result, having multiple antennas in a close proximity poses significant coupling and mode isolation problems; furthermore, the signals received by each of the antennas may be undesirably correlated. This noticeably disrupts MIMO performance.

Thus it can be seen that designers of antennas for mobile devices face significant challenges, particularly wherein the antennas may be capable of covering as many bands as possible while being small in size and still having a high performance.

One form of antenna commonly used in mobile devices is the monopole antenna. Compared to PIFA or IFA, a monopole can easier achieve large bandwidth because they may be arranged to radiate at two or more resonant frequencies (from its fundamental mode, second order and higher modes) Since a monopoles inherent dual mode characteristic makes it easy to achieve a frequency ratio of two-to-one of its upper and lower frequency band.

However using a single radiator for multi-order modes poses a difficulty, particularly if specific frequency bands are to be adjusted independently. Additionally, in a single radiator if one of the operating bands is required to be relatively wide the monopole may not cover all bands, such as GSM 900 (880 to 960 MHz) at a lower band and GSM1880/1900 and UMTS2100 (1710 to 2170 MHz) together at an upper band, unless additional parasitic branches are used to enhance the bandwidth and adjust the frequency ratio. However this introduces additional volume and potential higher-mode coupling among radiation elements.

Another disadvantage is that since a monopole is typically a quarter-wavelength of the fundamental mode, the size of the antenna is increased when it is designed to operate at lower resonant frequency bands.

Accordingly, it is desirable to have a monopole that may be arranged in a limited space.

BRIEF DESCRIPTION OF THE DRAWINGS

The present disclosure will be better understood with reference to drawings in which.

DETAILED DESCRIPTION

Figure 1:
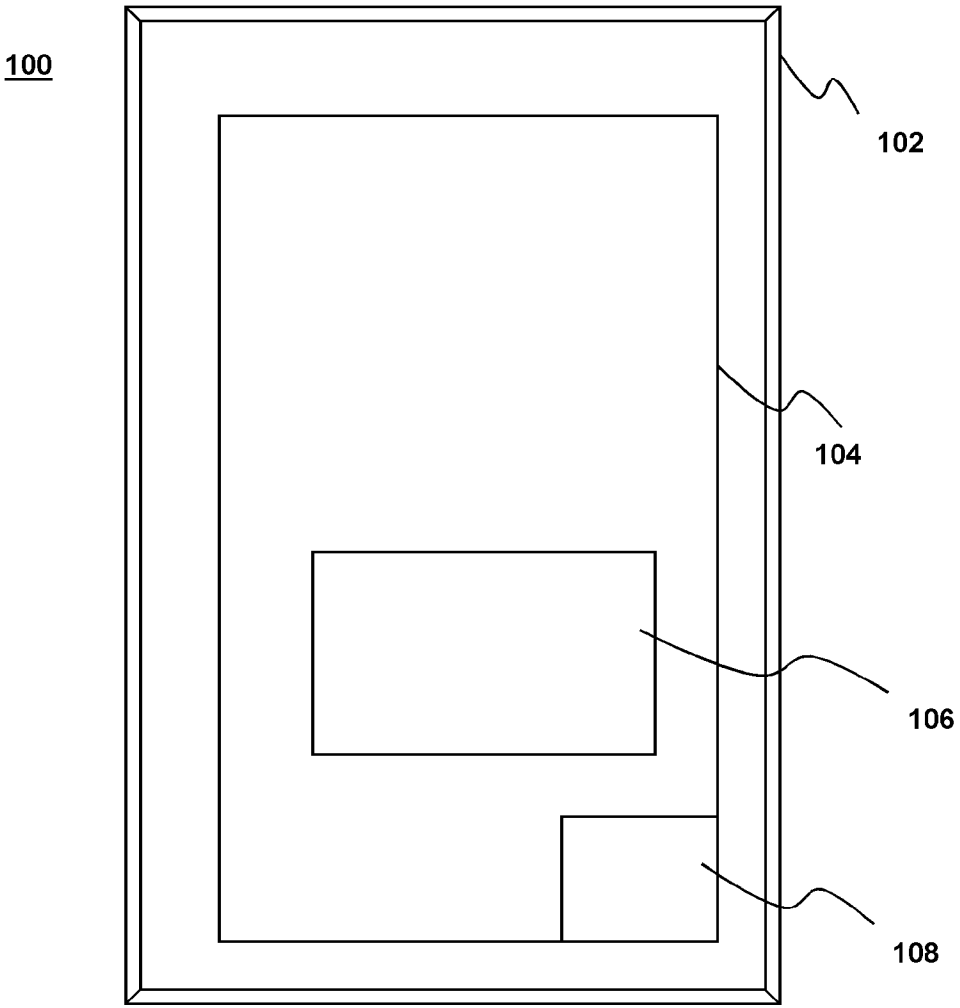
FIG. 1 shows a schematic block diagram of a mobile wireless communications device in accordance with an exemplary embodiment including a monopole antenna.

In the following description like numerals refer to like structures illustrated in the drawings. For clarity a set of orthogonal axes x-y-z are shown in the drawings, where appropriate, to provide a frame of reference for describing the relative arrangement of the structures in the various drawings. The terms horizontal and vertical where used are for convenience of describing structures oriented with respect to the x-y plane and the y-z plane respectively, and are not meant to be limiting.

The present matter describes multi-band three-dimensional (3D) folded monopole antennas for use in mobile devices. More particularly the present matter describes a small compact multi-radiation element antenna that exhibits high mode isolation allowing it to cover several communication application frequency bands such as GSM 1900, UMTS2100, GPS, WALN in the 2 GHz and higher range and the lower bands such as 1 GHz and wherein the operational frequency bands of antenna elements can be adjusted independently i.e. the upper bands can be adjusted independently of the lower bands. In other words the high mode isolation allows the antenna to function at different operation frequencies.

Furthermore, the multi-radiation element antenna also exhibits high isolation between the radiation elements. In other words there are low couplings (or power transferred from one element to another) at the operation frequencies of the antenna.

Furthermore the present matter describes a multi antenna array comprised of two or more of the multi-radiation element antennas, wherein the antennas of the array also exhibit high isolation.

In accordance with a first aspect of the present matter there is provided a multi-band antenna comprising a dielectric substrate, a ground plane formed on a first area of the dielectric substrate, a radiation part arranged on a second area of the dielectric substrate where the ground surface is not formed, a feed section formed of a metallic trace and having one end connected to the radiation part and an opposite end disposed near an edge of the ground plane for forming a feed point. The radiation part having a pair of monopole antenna elements formed of conductive metallic traces; a first monopole for radiating at a first resonant frequency, and a second monopole for radiating at a second resonant frequency and the conductive metallic traces being folded to form a three dimensional structure, with at least a portion of the first monopole spaced from a plane of the substrate and the second monopole.

There is further provided a patch element coupled to the second monopole and arranged in a spaced relationship to the first monopole, a width of the patch element for determining the resonant frequency of the second monopole antenna element, independently of the resonant frequency of the first monopole.

There is further provided a dielectric shell defining a generally rectangular shape having opposing top and bottom faces, opposing first and second end faces and opposing first and second side faces, the bottom face of the dielectric shell positioned in the second area of the substrate and the three dimensional structure of the metallic trace being formed around the dielectric shell.

In accordance with a further aspect there is provided a mobile wireless communication device comprising a housing, a dielectric substrate carried within the housing, wireless communication circuitry carried by the substrate within said housing, and a multi-band antenna coupled to the wireless communication circuitry and comprising a ground plane formed on a first area of the dielectric substrate, a radiation part arranged in a second area of the dielectric substrate where the ground surface is not formed, a feed section formed of a metallic trace and having one end connected to the radiation part and an opposite end disposed near an edge of the ground plane for forming a feed point; and the radiation part formed of conductive metallic traces; a first monopole for radiating at a first resonant frequency, and a second monopole for radiating at a second resonant frequency and the conductive metallic traces being folded to form a three dimensional structure, with at least a portion of the first monopole spaced from a plane of the substrate and the second monopole.

In accordance with a still further aspect there is provided a mobile wireless communication device comprising a housing, a dielectric substrate carried within said housing, wireless communication circuitry carried by the substrate, a ground plane formed on a first area of the dielectric substrate, a plurality multi-band antennas arranged in a second area of the dielectric substrate where the ground surface is not formed and coupled to said wireless communication circuitry, each of the multi-band antennas having a pair of monopole radiating elements including a patch element associated with respective ones of the multi-band antennas, a width of the patch element for determining a resonant frequency of its associated antenna.

There is further provided in the still further aspect a stub section coupled to the ground plane and extending into the second area, a stub size being selected for determining an operating frequency and isolation of the multi-band antennas.

In accordance with a still further aspect there is provided a method for implementing a multi-band antenna for use in a mobile device, the method comprising forming a ground plane in a first area of a dielectric substrate, the dielectric substrate for positioning within a housing of the mobile device; arranging a plurality of multi-band antennas in a second area of the dielectric substrate where the ground surface is not formed, the antennas for coupling to wireless communication circuitry, each of the multi-band antennas having a pair of monopole radiating elements including a patch element associated with respective ones of the multi-band antennas; and determining resonant frequency of respective antennas by adjusting a width of the patch element associated with that antenna.

In accordance with a still further aspect the method includes selecting a size of a stub section for extending the ground plane into the second area, for determining an operating frequency and isolation of the multi-band antennas.

Referring to FIG. 1 there is shown a mobile wireless communications device 100 including a housing 102, a substrate 104 carried within the housing, the substrate 104 having a ground plane (not shown) on one side thereof, wireless communications circuitry 106 carried within the housing 102 and located over the substrate 104 and a multi-band folded monopole antenna assembly 108 coupled to the wireless communications circuitry 106. By way of example, the wireless communications circuitry 106 may comprise cellular communications circuitry, e.g., a cellular transceiver. Other wireless communications circuitry, such as wireless local area network (WLAN) and satellite positioning (e.g., GPS) communications circuitry, may also be used.

Figure 2A:
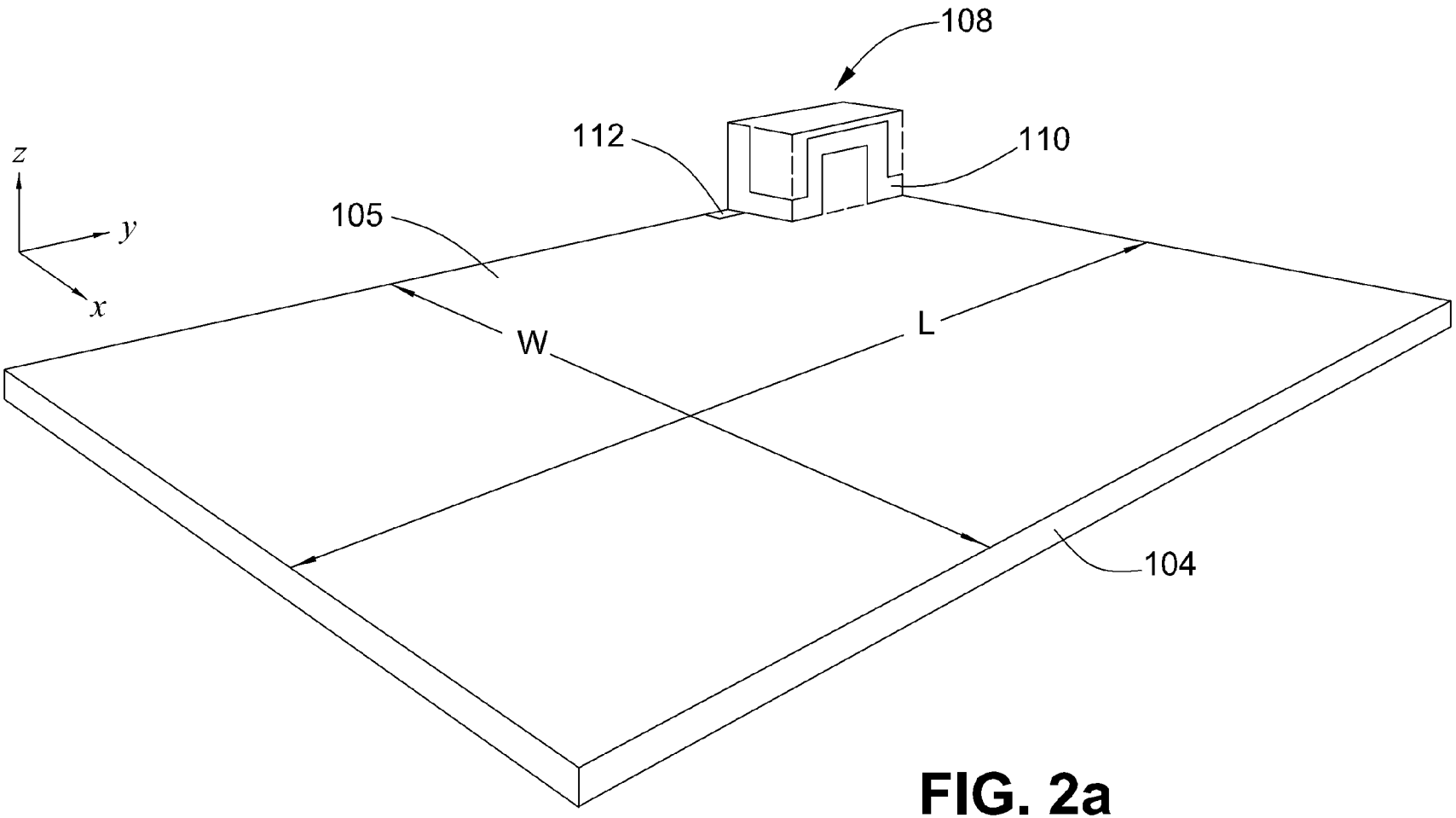
FIGS. 2*a-e* show schematic diagrams of various aspects of an implementation of a multi-band three-dimensional (3D) folded monopole antenna assembly, according to an embodiment of the present matter.
Figure 2B:
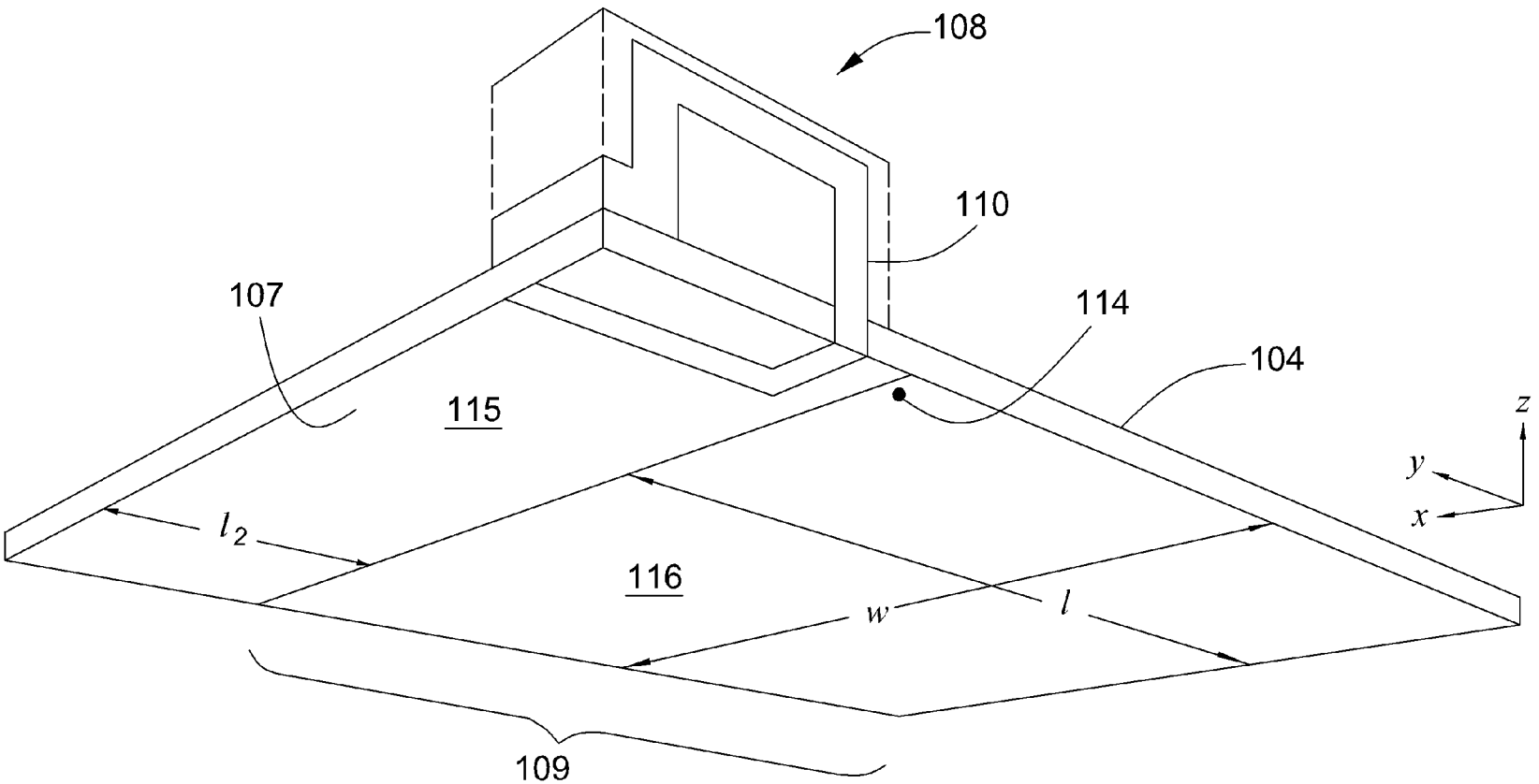

Referring to FIGS. 2*a-e* there is shown various aspects of an implementation the multi-band three-dimensional (3D) folded monopole antenna assembly 108 according to an embodiment of the present matter. In these views it is assumed that major surfaces 105, 107 of the substrate 104 lie in the x-y plane. The antenna assembly 108 comprises a radiation part comprised of pair of monopoles formed of conductive metallic strips 110 folded into a 3D rectangular structure and located substantially on a top surface 105 and to one corner of the substrate 104, as shown in FIG. 2*a*, a feed section 112 also located on the top surface 105 of the substrate connects the monopoles to a feed point 114 for coupling RF signals to and from the monopoles via a 50Ω connector (not shown). Furthermore, as more clearly shown in the bottom perspective view of FIG. 2*b* a ground plane 116 is located on a bottom surface 107 in a first area 109 of the dielectric substrate 104. As may be further seen from the figure, the radiation part is arranged in a second area 115 of the dielectric substrate where the ground plane is not formed. In an exemplary implementation the ground plane 116 is comprised of a metallic layer of polygonal shape having one edge delineating a boundary between the first area 109 and the second area 115. In an exemplary implementation the ground plane is rectangular, having a width (w) of 55 mm and length (l) of 90 mm and the substrate 104 is comprised of a 1.5 mm thick FR4 material with a dielectric constant of 4.4, having a width (W)

of 55 mm and length (L) of 105 mm. The dimension of the substrate is usually constrained by the size of the mobile device housing.

Figure 2C:
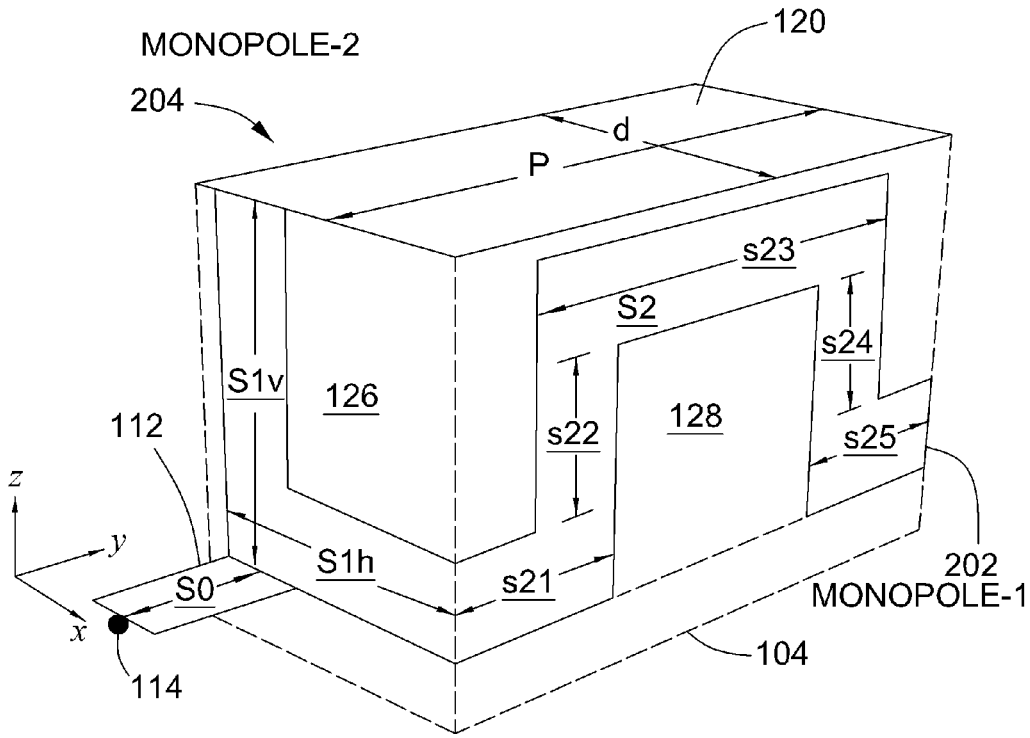
Figure 2D:
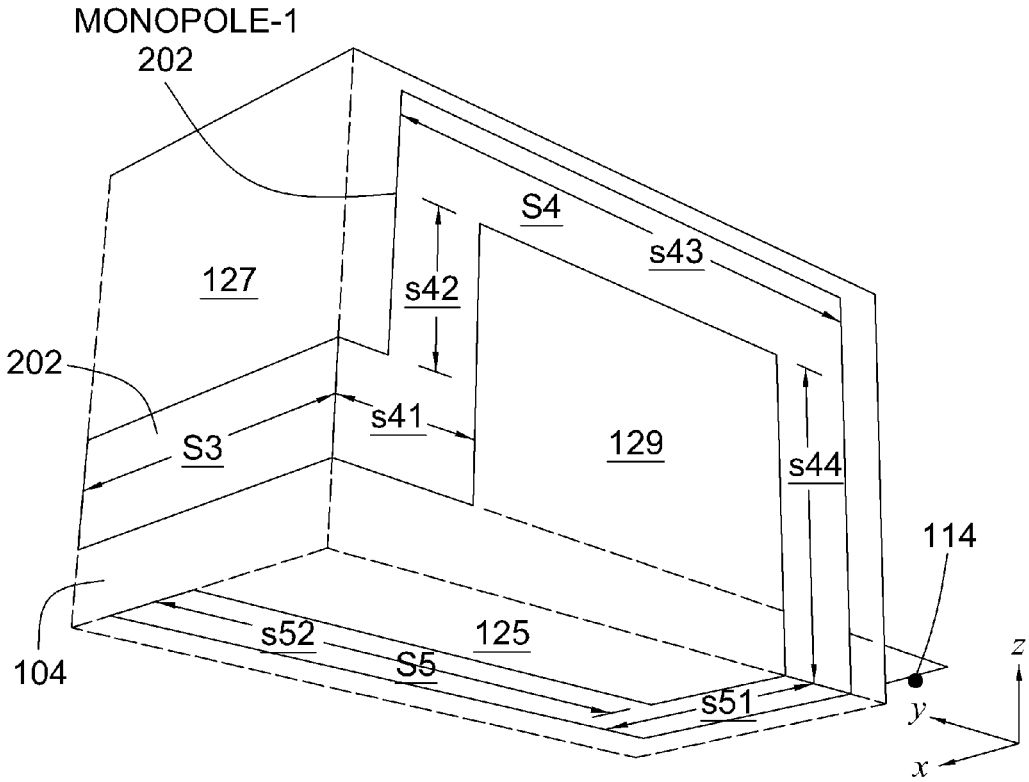
Figure 2E:
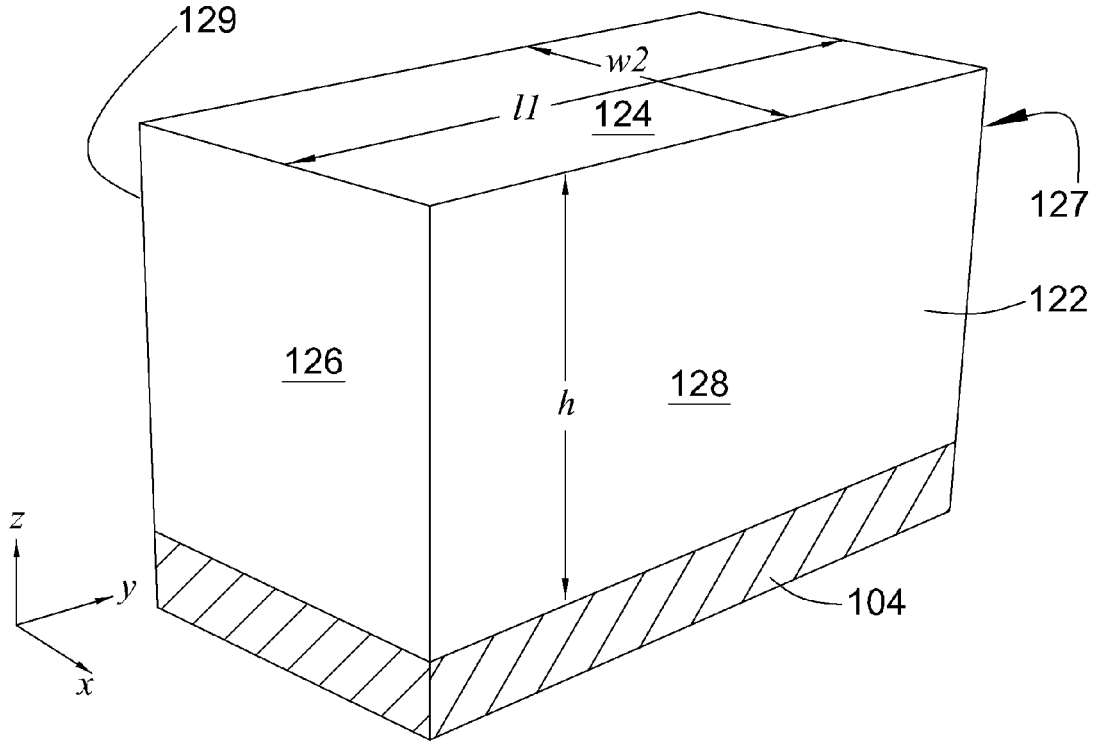
Figure 3:
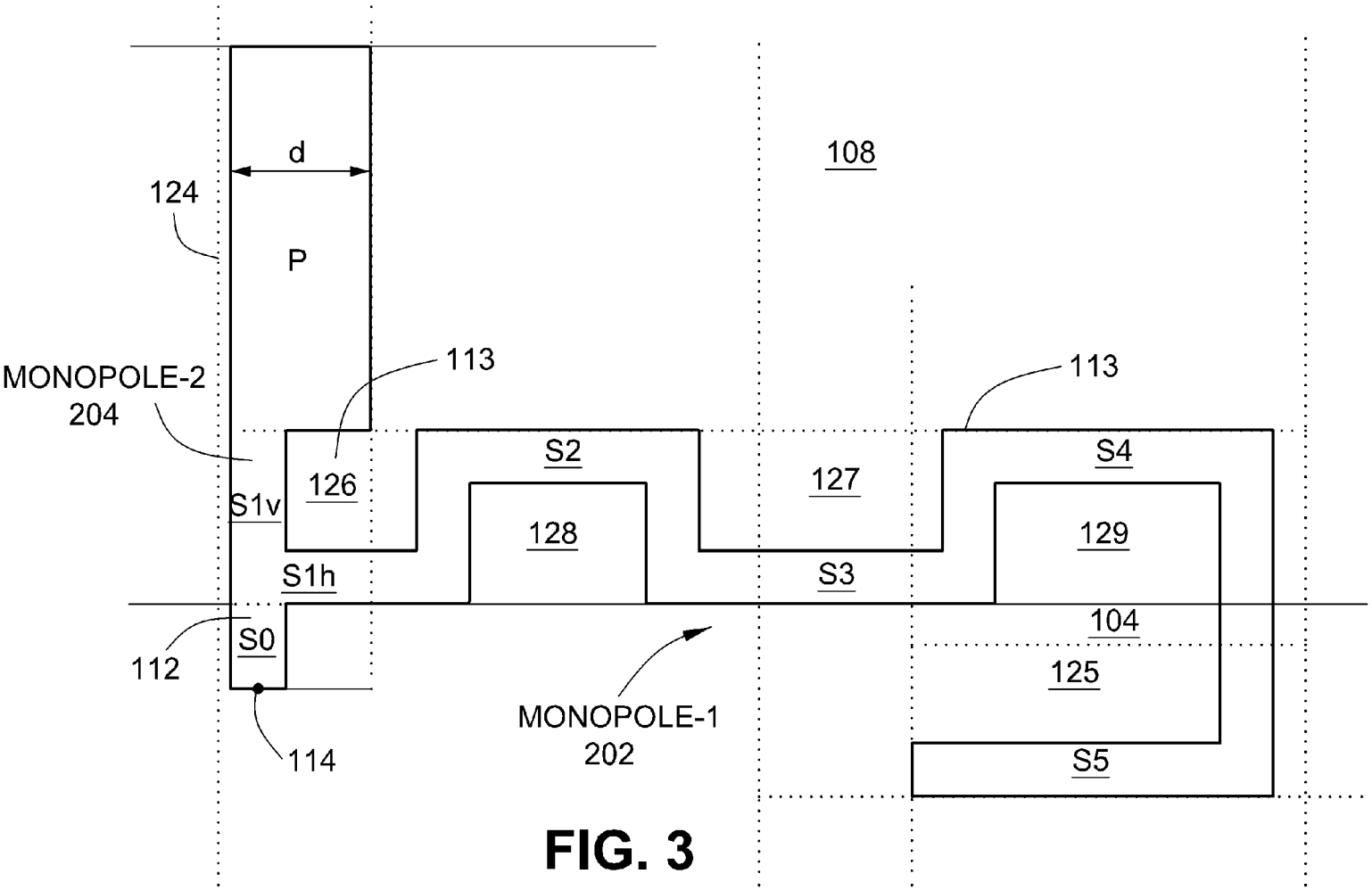
FIG. 3 shows an unfolded two-dimensional (2D) view of the antenna of FIG. 2.

The 3D geometrical configuration of the pair of folded monopoles is shown more clearly in FIG. 2*c* and FIG. 2*d*, and an unfolded two-dimensional (2D) view is shown in FIG. 3. The pair of folded monopoles comprise a first and second monopole antenna elements monopole-1 202 and monopole-2 204 formed of conductive metallic traces 110, extending at right angles to each other, from the feed section 112, the first monopole monopole-1 202 for radiating at a first resonant frequency, and the second monopole monopole-2 204 for radiating at a second resonant frequency higher than the first frequency, and a patch element 120 coupled to the second monopole for determining the resonant frequency of the second monopole antenna element monopole-2 204. In FIGS. 2*c* and 2*d* the continuous metallic trace 110 is folded to take a generally rectangular shape and in an exemplary implementation is supported by a rectangular shaped dielectric shell 122 as shown more clearly in FIG. 2*e*. The dielectric shell 122 is mounted on a surface of the substrate 104 opposing the surface of the ground plane, referred to as the top surface 105 in FIG. 2*a*. For the purpose of the description following the faces of the dielectric are referred to as opposing top 124 and bottom 125 faces in an x-y plane, opposing first 126 and second 127 end faces in an x-z plane, and opposing first 128 and second 129 side faces in the y-z plane. It is to be noted that the bottom face 125 is formed by the substrate 104.

As shown in FIG. 3 the folds of the metallic trace are made along the dashed lines, representing fold lines. In an exemplary implementation the metallic trace 113 has a uniform width of 2 mm and is folded such that first monopole antenna element monopole-1 202 includes a continuous metallic trace comprised of the feed section S0 112 extending from the feed point 114 to a first horizontal section S1*h* arranged along a lower portion of the first end face 126 of the dielectric shell 122 to form a first L shaped section comprising S0 and S1*h* a first U-shaped section S2 on the first side face 128, a second U-shaped section including a horizontal section S3 extending along a lower portion of the second end face 127, a third U-shaped section S4 on the second side face 129 and ending in a second L-shaped section S5 on the bottom face 125. The second monopole monopole-2 204 is composed of the feed section S0, a vertical section Sly extending vertically along the first end face 126 and the patch P 120 formed on the top face 124. It may be seen that the antenna is composed of three U-shaped sections formed generally of strips S2, S3, and S4 and two L-shaped section formed of strips S1 and S5.

As the total length and layout of each monopole antenna element determines the antenna's performance, the total length may be optimized taking into account the constraints on the volume for the antenna and the desired resonant frequency. The total length controls the fundamental resonating mode of the monopole elements, as will be appreciated by those skilled in the art. The modes at higher frequencies are generated at various portions of this length.

The 3D wrapping of the antenna controls the current distribution along the monopole length, and thus controls the electrical length(s) for the higher resonant frequency band(s) as well as antenna bandwidth, as will also be appreciated by those skilled in the art.

The initial electrical length of the first and second monopoles is set to a quarter of the wavelength of respective first and second resonant frequencies for the chosen fundamental modes. In an implementation the fundamental mode is set at 1 GHz for the first monopole and 2 GHz for the second monopole. The geometric parameters may be optimized by using electromagnetic simulators such as those based on Finite-difference time-domain (FDTD) computational electrodynamics modeling techniques, as is known in the art. An example of which is a commercially available program by CST.

The width d of the patch 120 varies the bandwidth and performance of the antenna. In an exemplary implementation the width d of the patch 120 is set to 2 mm, identical to the width of the other strips. The dielectric shell has dimensions of 14 mm in length (l1), 7 mm in width (w2) and 7.5 mm in height (h). It is to be noted that the dielectric shell is mounted to the top surface of the substrate and thus the height of the dielectric shell is increased by 1.5 mm, the thickness of the substrate 104. The lengths of the sections of metallic strips for the first monopole are as follows: S0=3 mm, S1*h*=7 mm, S2=[s21=4 mm, s22=2.5 mm, s23=10 mm, s24=2.5 mm, s25=4 mm], S3=7 mm, S4=[s41=40 mm, s42=2.5 mm, s43=12 m, s44=6 mm], S5=[s51=5.5 mm, s52=11 mm]. The lengths of the sections of metallic strips for the second monopole are as follows: S0=3 mm, S1*v*=7.5 mm (the vertical section) and P=14 mm. The above dimensions are for an exemplary embodiment; however, it will be appreciated by those skilled in the art that other dimensions and/or materials may be used in different embodiments.

Figure 4:
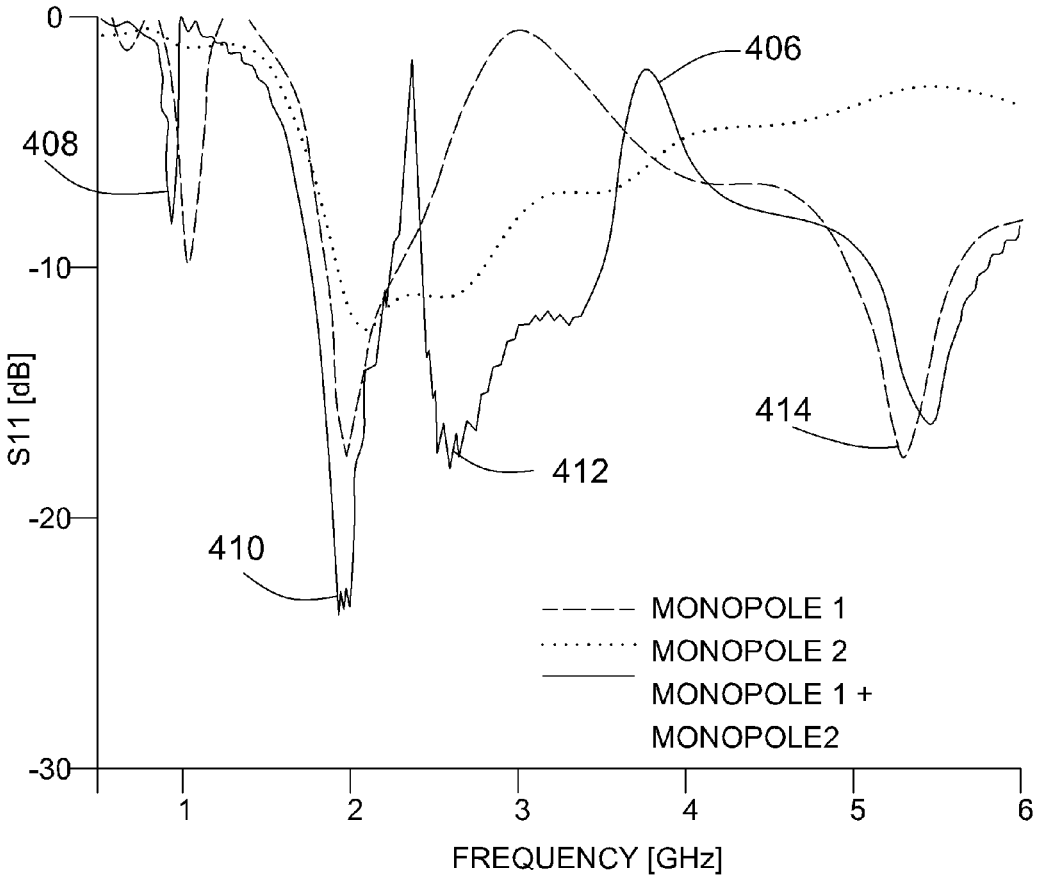
FIG. 4 shows a graph of a comparison of simulated reflection coefficients for the antenna of FIG. 2.

Referring to FIG. 4 there is shown a comparison of simulated reflection coefficients for the antenna, having dimensions as above, when monopole-1 202 is excited on its own 402; monopole-2 204 is excited alone 404, and the combined reflection coefficients when monopole-1 202 and monopole-2 204 are excited simultaneously 406. As may be seen, when the two monopoles are excited at the same time, the antenna exhibits four resonant frequencies of 0.95 GHz (408), 2 GHz (410), 2.5 GHz (412) and 5.4 GHz (414). When compared to the reflection coefficients for the separately excited monopoles, the bandwidths and impedance matching at the frequencies of 0.95 GHz, 2 GHz and 5.4 GHz for the simultaneously excited monopoles are not significantly different. However at 2.5 GHz the bandwidth is significantly enhanced. Thus, it may be seen that one of the monopoles, in this case the first monopole monopole-1 202, determines the bandwidths and resonant frequencies at 0.95 GHz, 2 GHz and 5.4 GHz bands, whereas the other monopole, in this case the second monopole monopole-2 204, determines the bandwidth at the 2.5 GHz band.

Furthermore, by simulating surface current distributions (not shown) for the antenna, having dimensions as above, it was demonstrated that the first monopole monopole-1 202 operates at its fundamental mode and the total length of the first monopole monopole-1 202 is approximately a quarter wavelength. As operation frequency is increased to 2 GHz, it was verified that the first monopole monopole-1 202 operates at the second-order mode of 2 GHz. At this frequency, the electrical length of the first monopole monopole-1 202 is a half wavelength. Furthermore, as the operation frequency is increased to 5.2 GHz, multiple nil points appear for the current distributions on the first monopole monopole-1 202. Hence, the antenna works at the higher order mode and its electrical length is more than one wavelength. In the case of the second monopole monopole-2 when it is excited alone at 2 GHz the currents also flow in a continuous direction, which means that the second monopole monopole-2 operates at the fundamental mode and its length is a quarter wavelength. Finally, when the two monopoles were simultaneously excited at several frequencies the frequency bands of 1 GHz, 2 GHz and 5.5 GHz, the first monopole monopole-1 202 had strong surface currents while the second monopole monopole-2 204 exhibited weak surface currents. Accordingly, it can be inferred that the two monopoles have high-mode isolation, and that the first monopole monopole-1 202 primarily determines these resonant frequencies. However, when the antenna operates at the 2.5 GHz band, the two monopoles exhibit strong surface currents, so they both have an influence in this band.

As mentioned earlier, the width d of the patch 120 changes the resonant frequency and bandwidth of the antenna. Accordingly, referring now to FIG. 5 there is shown the reflection coefficients for the pair of monopole antennas 108 for different patch widths d i.e. d=2 mm (502), d=4 mm (504) and d=6 mm (506). It may be seen that in the frequency range from 2.2 to 4 GHz the plots of the reflection coefficients for the different widths d show changes in the resonant frequency and bandwidth, but for frequencies below 2 GHz there is little difference in the plots except for a slight adjustment in impedance matching. This is further evidence that the monopoles have high mode-isolation. This high mode-isolation, allows the lower and the upper bands of the antenna to be easily set by changing the geometric parameters of the first and second monopoles independently.

Figure 5:
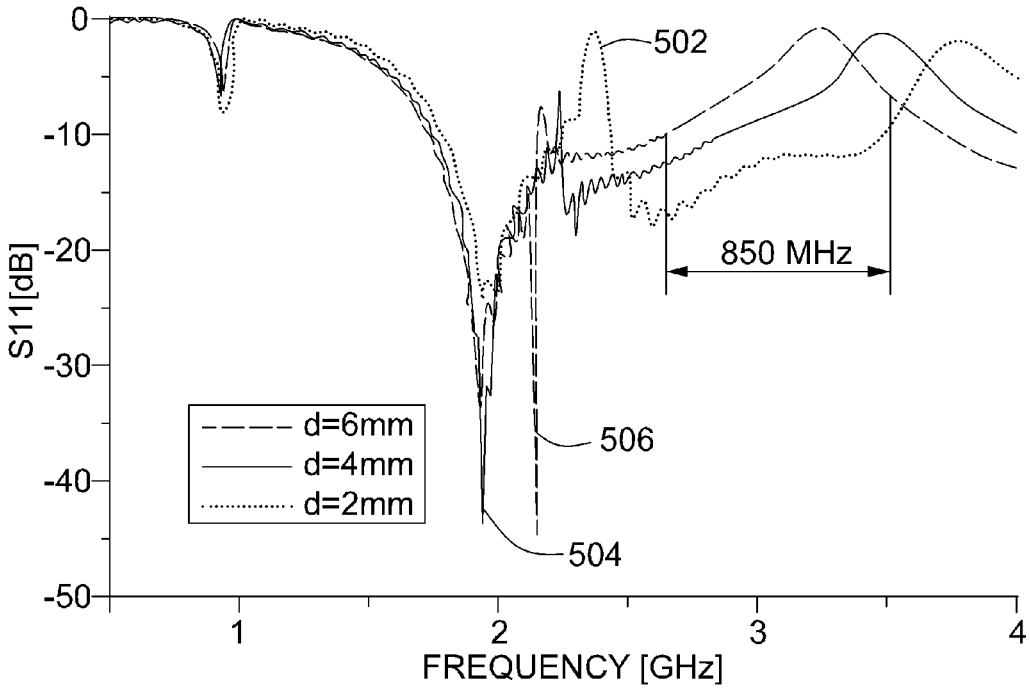
FIG. 5 shows a graph of reflection coefficients for the antenna of FIG. 2 for different patch widths.

Another characteristic shown in FIG. 5 is that even by changing the patch width d and thereby varying a resonant frequency range, the antenna continues to be useful in a number of applicable frequency bands. In the exemplary implementation this ranges from 2 GHz to 4 GHz, which covers frequency bands applicable to GSM 1800/1900, UMTS2100, Blue-tooth 2.4 GHz, WiFi/LTE 2.6 GHz, WiMAX 3.3 to 3.8 GHz.

In applications requiring frequency agility RF-switches, such as RF-MEMS (Radio-Frequency Micro-Electro-Mechanical System), may be used to dynamically increase or decrease the patch P width d so that the antenna provides greater flexibility.

Figure 6:
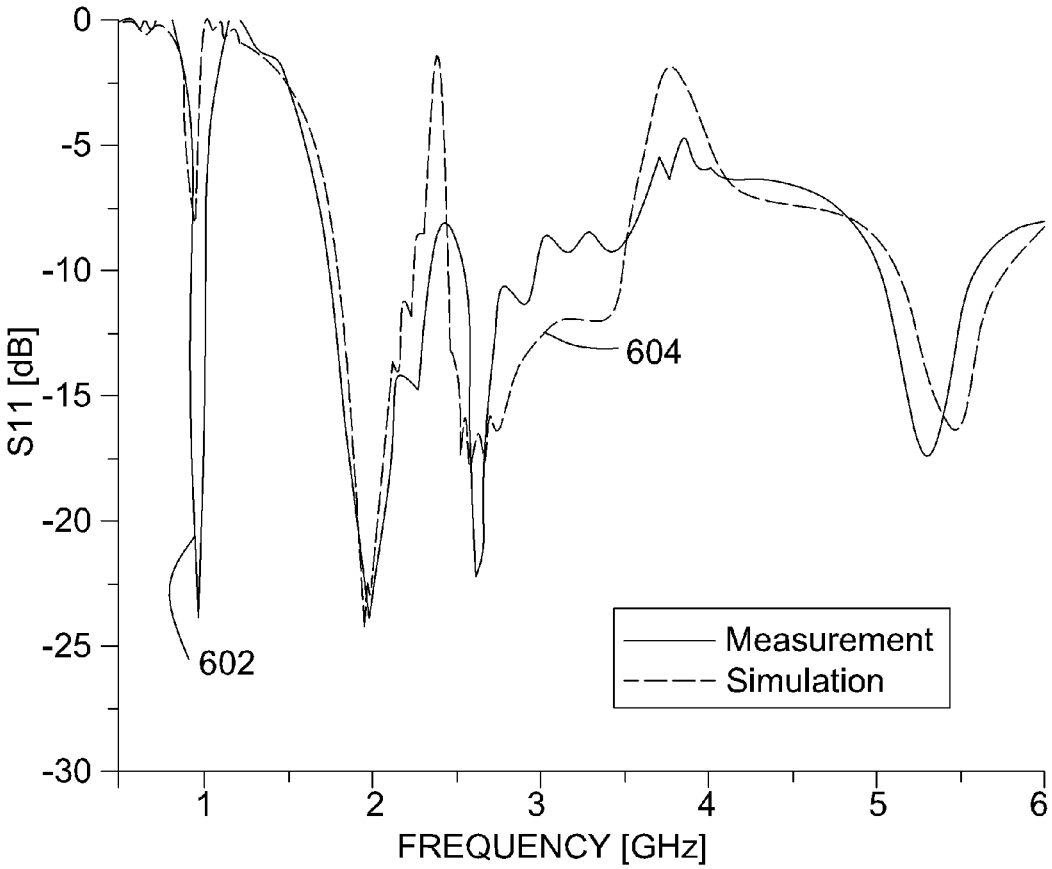
FIG. 6 shows a graph of measured and simulated reflection coefficients for the antenna of FIG. 2.

Referring to FIG. 6 there is shown a comparison of a measured 602 and simulated 604 reflection coefficient S11 for an exemplary implementation, where the patch width d is 2 mm. It may be noted that for a 6 dB return loss the frequency range for the antenna is from 880 to 1000 MHz, which is within the frequency range for GSM 900 applications. Furthermore as shown in FIG. 6 the impedance bandwidth of 10 dB return loss is from 1700 MHz to 2820 MHz, which covers multiple applications at GSM/1800/1900 and UMTS 2100, long term evolution (LTE) 2.1 and 2.6 GHz bands.

Figure 7A:
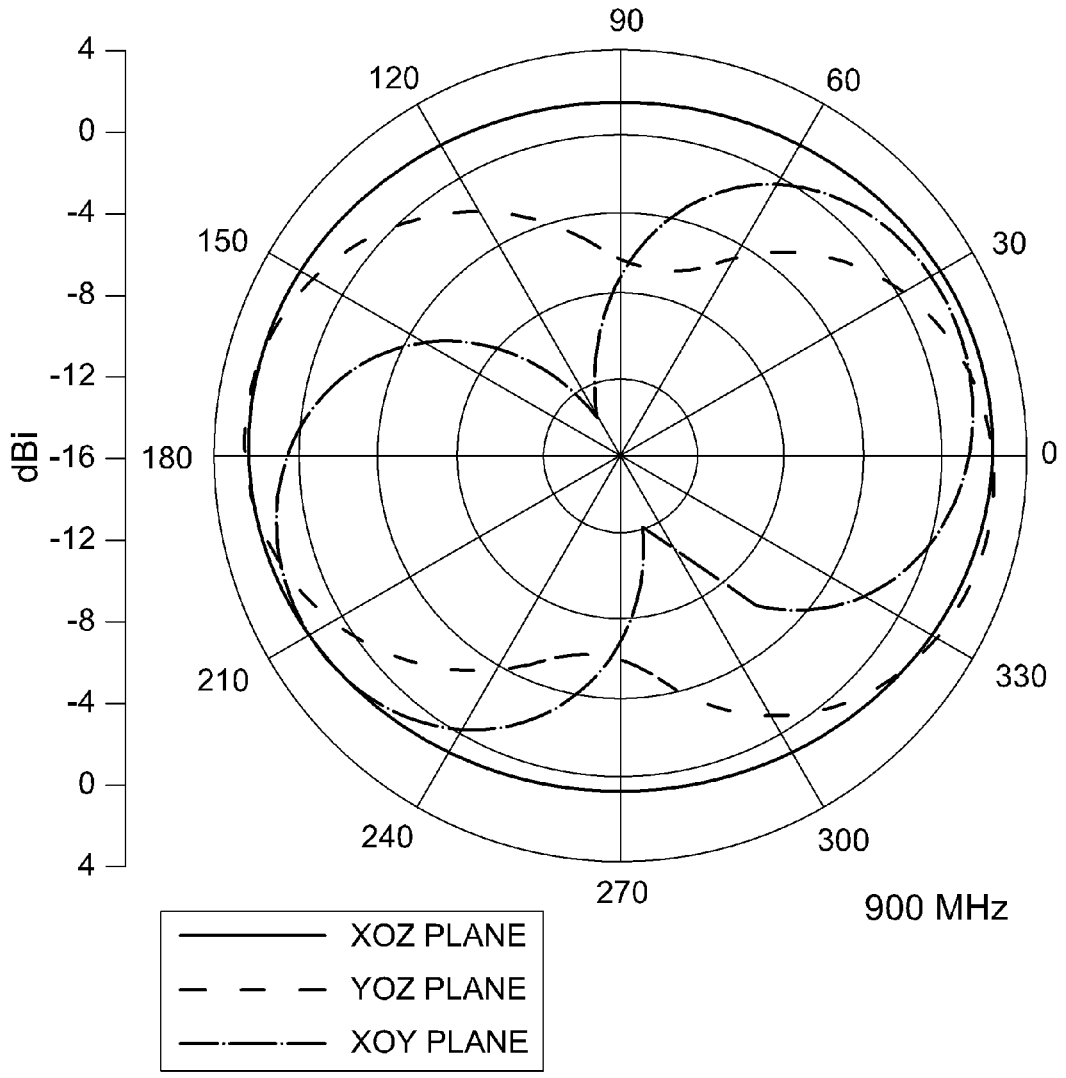
FIGS. 7*a*-7*d* shows graphs of measured far-field radiation patterns at respective resonant frequencies of 900 MHz, 1800 MHz, 2.5 GHz and 5.5 GHz for the antenna of FIG. 2.
Figure 7B:
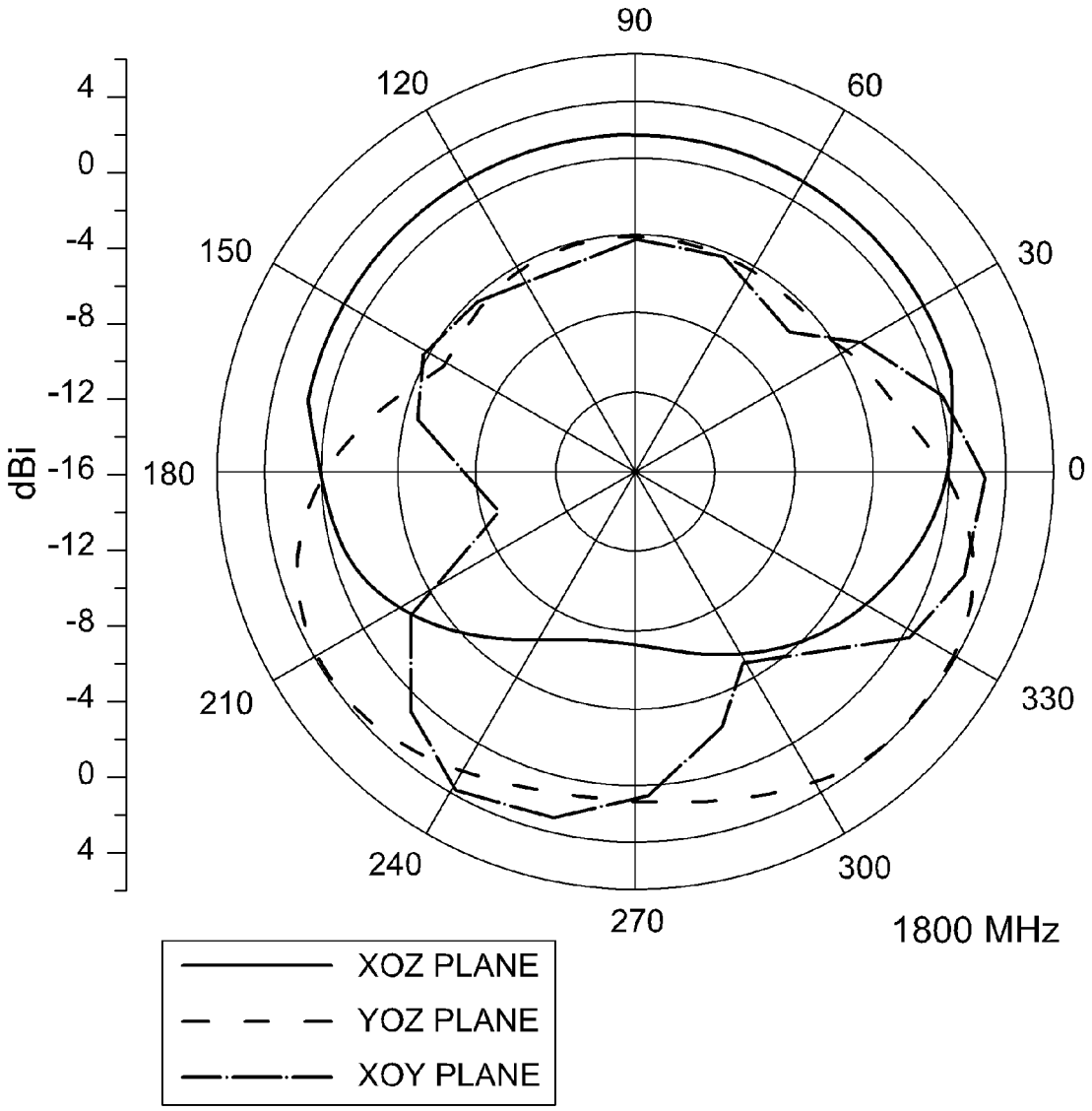
Figure 7C:
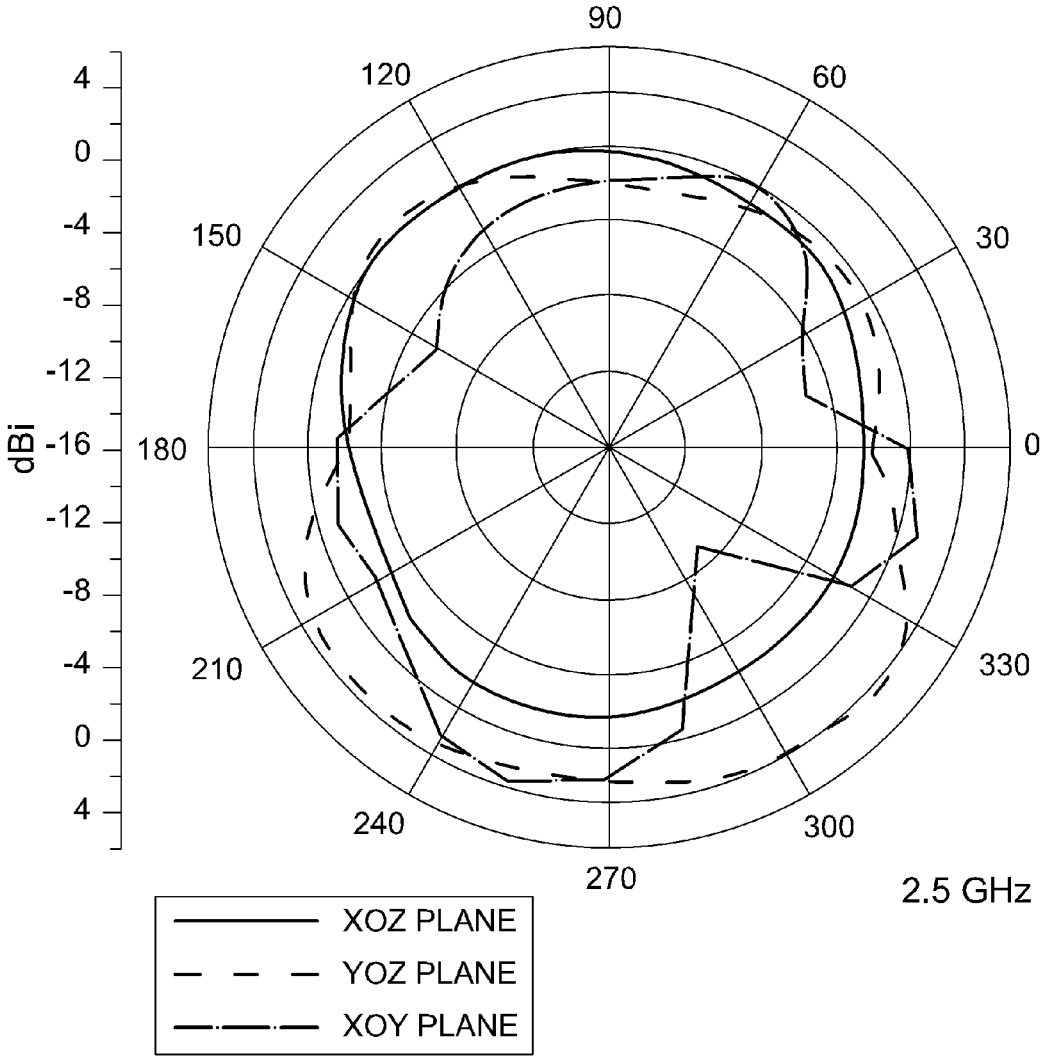
Figure 7D:
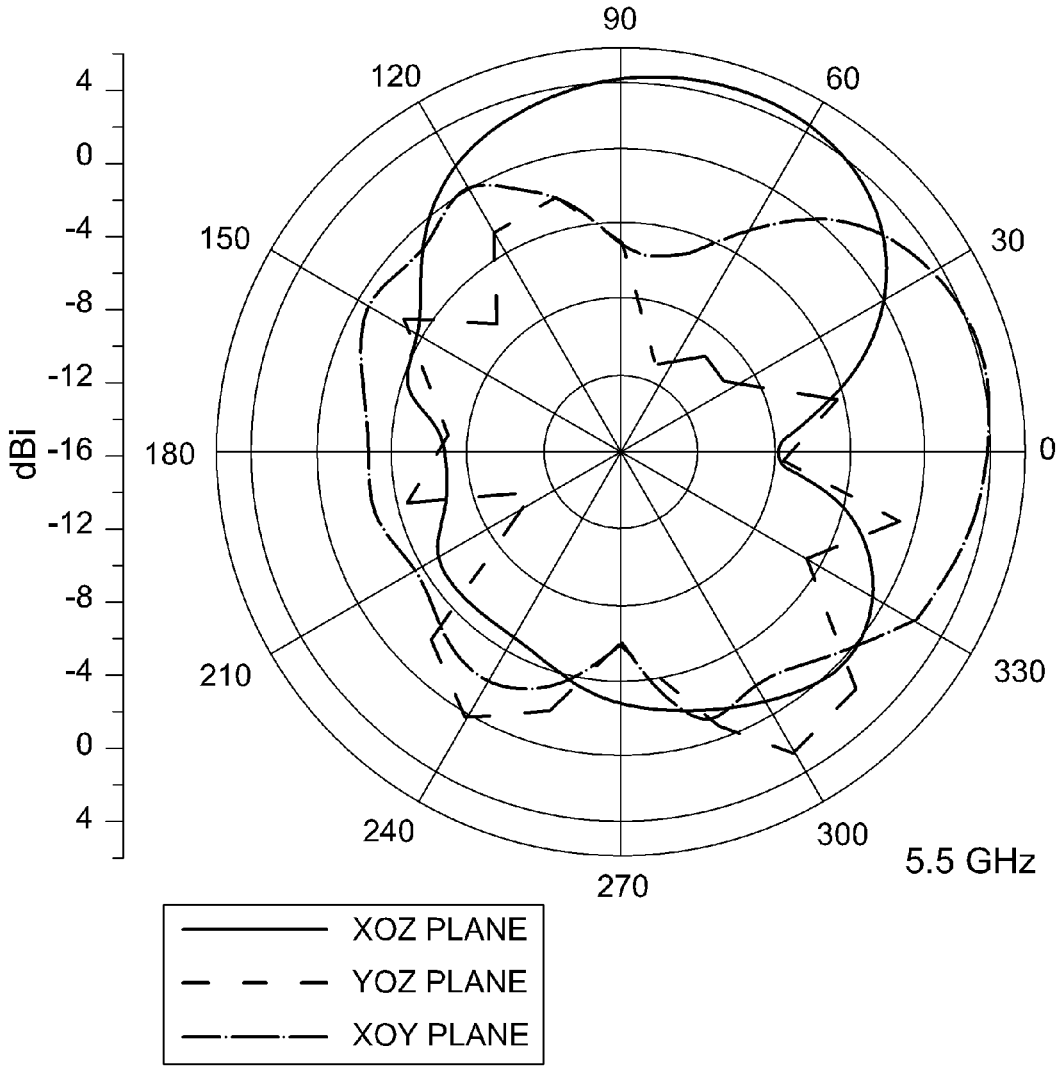

Referring, additionally to FIGS. 7*a*-7*d* there is shown a logarithmic polar plot of measured far-field radiation patterns at resonant frequencies of 900 MHz (FIG. 7*a*), 1800 MHz (FIG. 7*b*), 2.5 GHz (FIG. 7*c*) and 5.5 GHz (FIG. 7*d*) of the exemplary implementation at the three planes of XOZ, YOZ and XOY, where the values are in units of dBi of gain. The orientation of the antenna for these measurements are the same as that of FIGS. 2*a*-*d* As may be seen from the radiation patterns the antenna peak gain ranges from −2 dBi to −0.5 dBi at 900 MHz band, from 1.5 to 2.9 dBi at the middle frequency bands (1.7 to 2.17 GHz) and from 4 to 6 dBi at the high frequency band (4.9 to 6 GHz). These radiation patterns are omni-directional and dipole-like at 900 MHz (FIG. 7*a*), but the patterns are directive at 1800 MHz (FIG. 7*b*), 2.5 GHz (FIG. 7*c*) and 5.5 GHz (FIG. 7*d*). Moreover, the total antenna efficiency was measured, which is defined as the ratio of the radiated power to the total power delivered to the input terminal of the antenna, i.e. the efficiency includes the impacts from mismatching loss, dielectric loss, and conductor loss. The antenna 108 achieved an efficiency of 50-75% from 824 MHz to 960 MHz, an efficiency of 58-85% from 1.6 GHz to 2.2 GHz and an efficiency of 50-75% from 4.9 to 6 GHz.

Figure 8A:
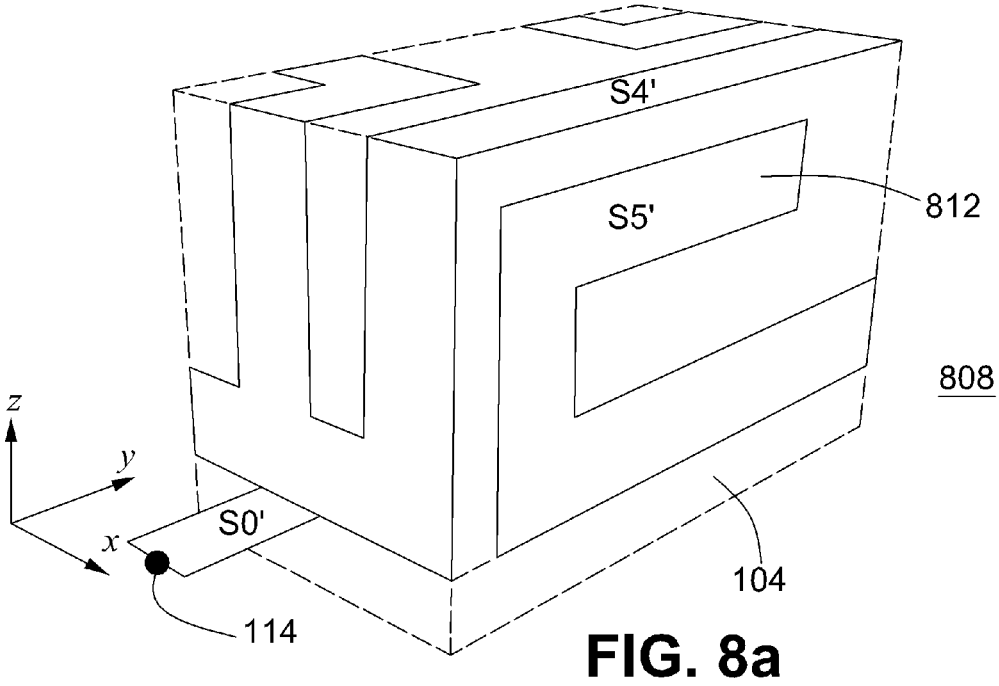
FIGS. 8*a-b* show schematic diagrams of respective top and bottom perspective views of an antenna according to another embodiment of the present matter.
Figure 8B:
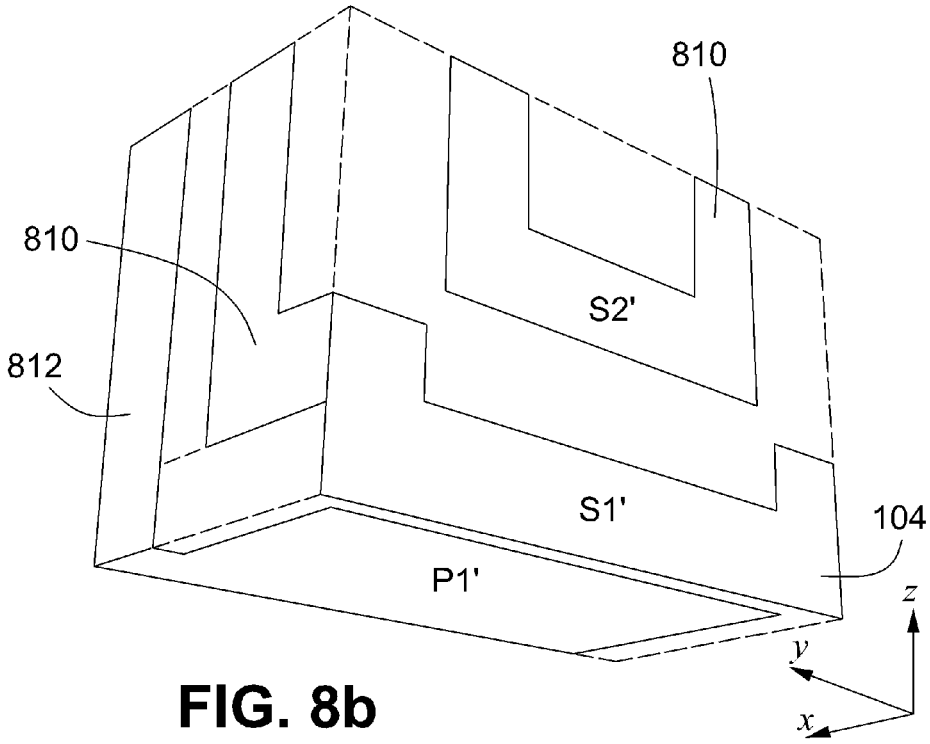

Referring now to FIGS. 8*a* and 8*b* there is shown respective top and bottom perspective views of the 3D geometrical configuration of a multi-band 3D folded monopole antenna 808 according to another embodiment of the present matter. As described earlier with respect to the antenna 108 shown in FIG. 2, the antenna 808 is also located at a top of a PCB, having a feed point and feed section similar to antenna 108. The antenna is positioned on the PCB and formed, in an exemplary embodiment, on a dielectric body 128 in a manner as previously described.

The antenna 808 also comprises two monopole antenna elements, 810 and 812 formed on the dielectric shell illustrated in FIG. 2*e*. In the embodiment illustrated, the first monopole 810 is composed of a first folded monopole comprising a continuous metallic trace of uniform width comprising a feed section S0' extending from the feed point 114 to a vertical section and two roughly U-shaped sections S1, S2' formed on a first side face of the dielectric body. The U-shaped sections S1', S2' form a loop back to the feed section S0'. A second monopole 812 is composed of the feed section S0', a section S4' extending vertically along the first end face, the top face, the second end face opposite the first end face of the dielectric body and ending in a patch P' formed on the bottom face of the substrate under the dielectric body. An L-shaped section S5' extends from the second end face section of the second monopole and is formed on the second side face opposite the first side face of the dielectric body. Also as described with the antenna 108 earlier, the patch P' in this embodiment is also spaced at distance h (the height of the dielectric body) from the first monopole. In this embodiment however one of the L-shaped sections (as described with respect to the embodiment of FIG. 2) is formed with the second monopole. The antenna response and performance are similar to the antenna 108 described earlier.

It may be seen from the above that there is described herein a compact 3D folded multi-band high mode-isolation, monopole antenna for handheld devices. The antenna has a simple structure and a small size combined with high-efficiency. As shown in the exemplary implementations, in addition to the two bands at 900 MHz and 5.5 GHz, the exemplary antennas provide a number of resonant frequencies within a desirable bandwidth in the frequency range of 2 GHz to 4 GHz by adjusting the patch width. This is useful when finalizing antenna designs because antenna adjustments are generally required at a late stage of product development. Typically large adjustments in the antennas dimensions are not feasible since the antenna's overall size has been fixed at the production stage.

Furthermore the antenna of the present matter can be easily adapted for used in mobile devices for reception of two or more unique radio signals, which require relatively low correlation between each of the received signals.

Figure 9A:
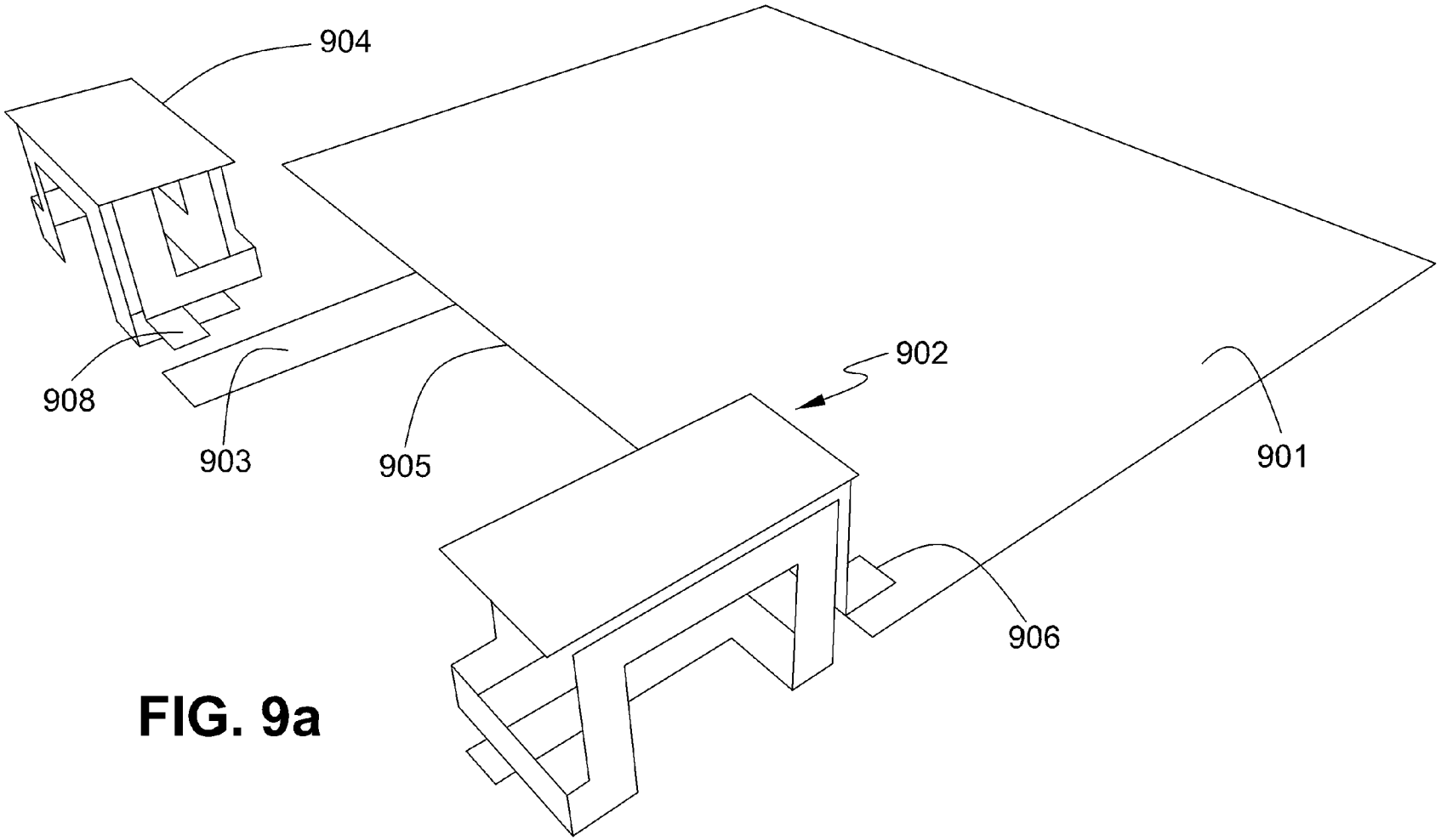
FIGS. 9*a-c* show schematic diagrams of multi-port antenna configurations according to further embodiments of the present matter.

Accordingly, referring now to FIG. 9*a* there is shown two-port antenna configurations 900, as an example of a multi-port antenna, using a pair of folded monopole antennas 108 of the present matter. For simplicity and illustrative purposes the configuration of the antenna in FIG. 9*a* is shown with the ground plane and antenna elements and without the substrate and dielectric. The antenna arrangement 900 includes a rectangular ground plane 901 as described earlier and a first 3D folded monopole antenna 902 and second 3D folded monopole antenna 904. The antennas are spaced apart and oriented 90 degrees with respect to each other in the second area 107 of the dielectric substrate where the ground plane 901 is not formed. A feed point 906 (port1) of the first antenna 902 is at one edge 905 of the ground plane 901 and a feed point 908 (port2) of the second antenna 904 is at a section of the ground plane 901, which includes a section of metal that extends the ground plane, herein referred to as a stub 903. In the illustrated implementation the stub 903 extends from the edge 905 of the ground plane into the second area 107 and between the spaced apart antennas to end in proximity to the feed point 908 of the second antenna 904. In An exemplary implementation the stub 903 has a length of 17 mm and a width of 10 mm.

Figure 9B:
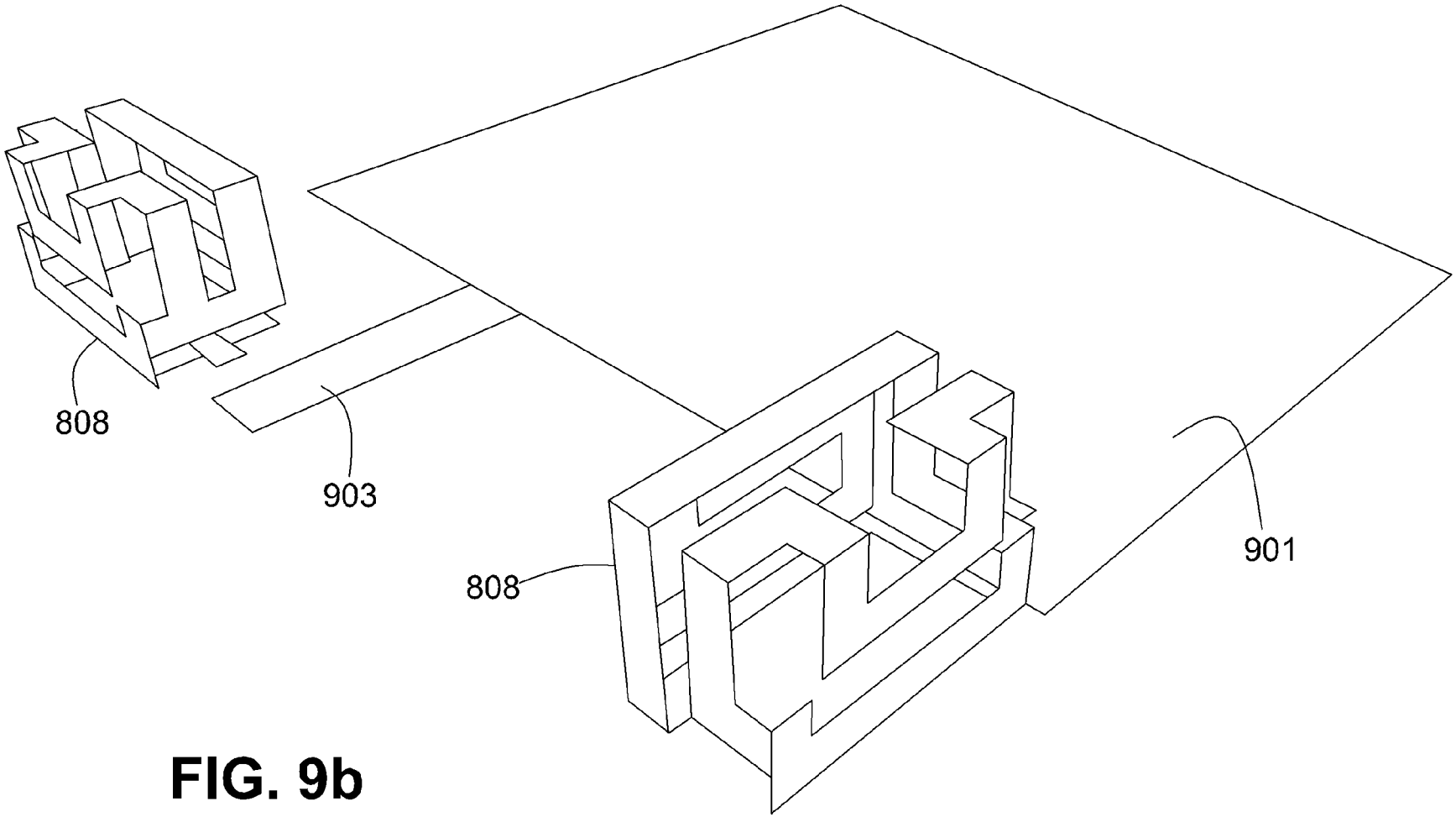
Figure 9C:
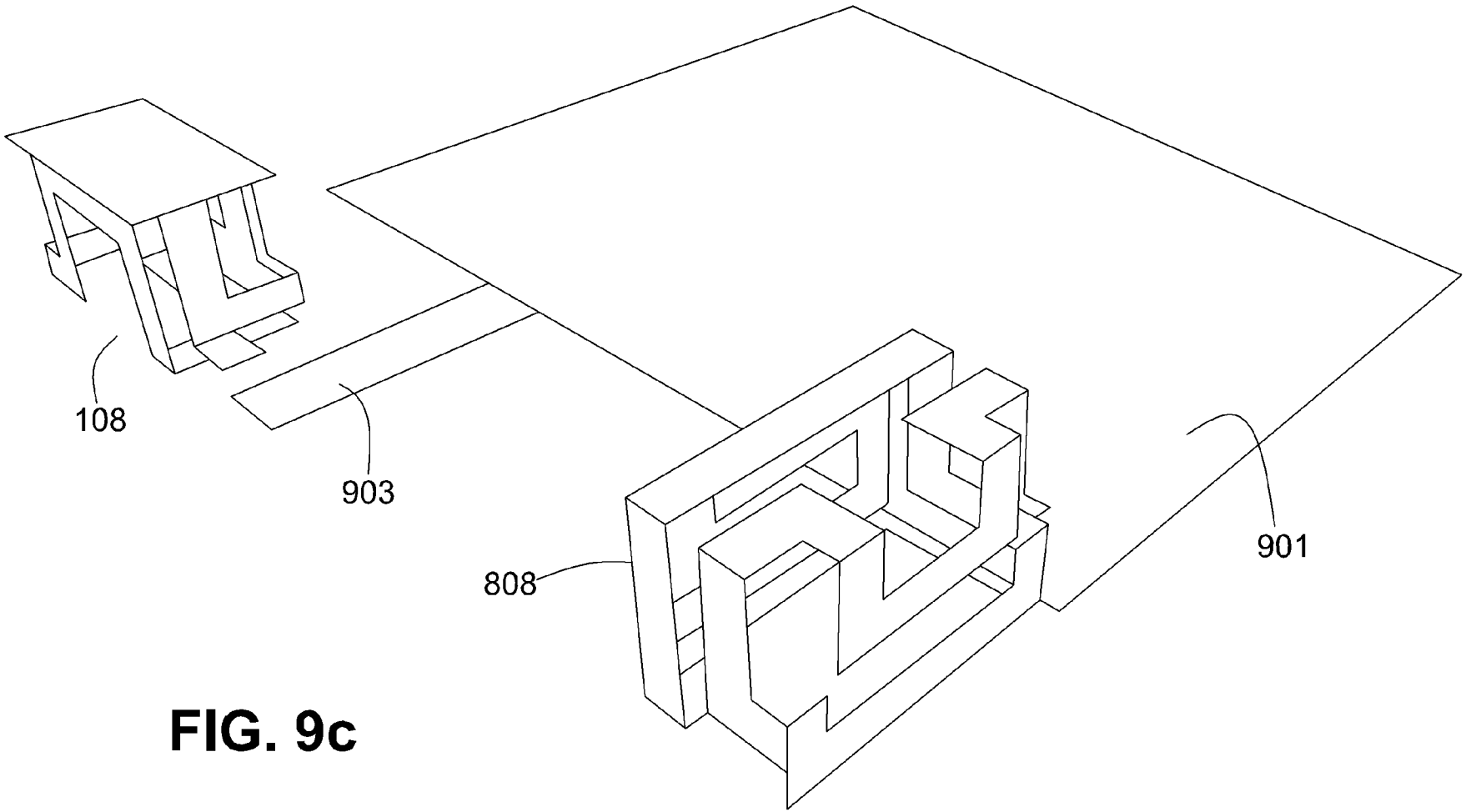

In FIG. 9*b*, there is shown the two-port configuration comprised of antennas 808 and in FIG. 9*c* there is shown the two-port configuration comprised of antennas 808 and 108 for the respective ports. Multi-port configurations can thus be built using one or more of the different pairs of monopole antennas described herein.

Figure 10:
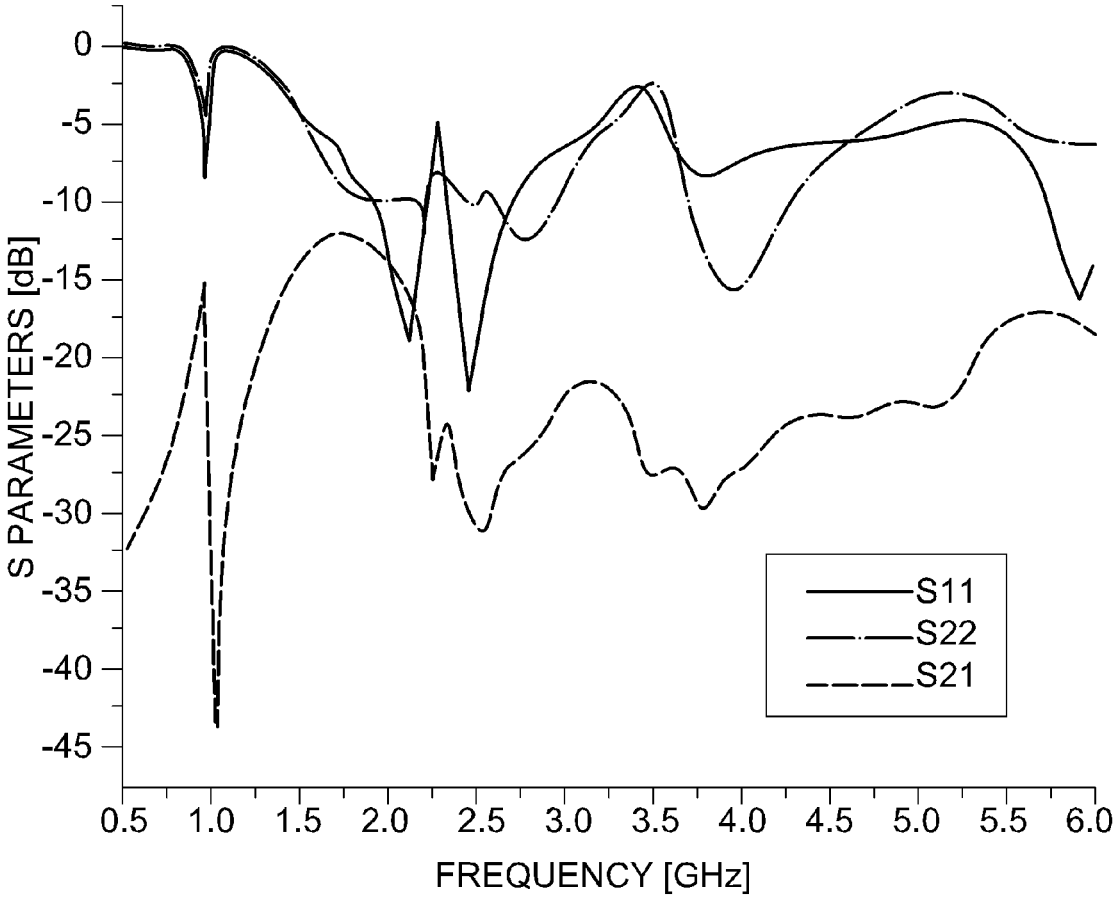
FIG. 10 shows graphs of measured S parameters, for the two-port antenna of FIG. 9*a;*

Referring to FIG. 10 there is shown plots of measured S parameters (S11, S21 and S22), for the dual port antennas, where S11 and S22 are reflection parameters and S21 is an isolation or coupling parameter. It can be seen that the dual-port antenna operates over multiple application bands, such as GSM/900/1800/1900, UMTS 2100 MHz bands, LTE 2.1/2.6 bands and WLAN 2.45/5 GHz bands, and the isolation between the two ports are better than −13 dB across all bands from 500 MHz to 6 GHz.

The isolation may be attributed to the two antennas having well implemented antenna diversities such as spatial, polarization and pattern diversity. Thus it may be seen that the diversity techniques applied to the pair of antennas result in high isolation (low coupling) between the two ports. For example, whereas the two monopole antenna elements of each antenna are arranged vertically with respect to each other for polarization and pattern diversities, each of the dual antennas are separated for spatial diversity.

Figure 11A:
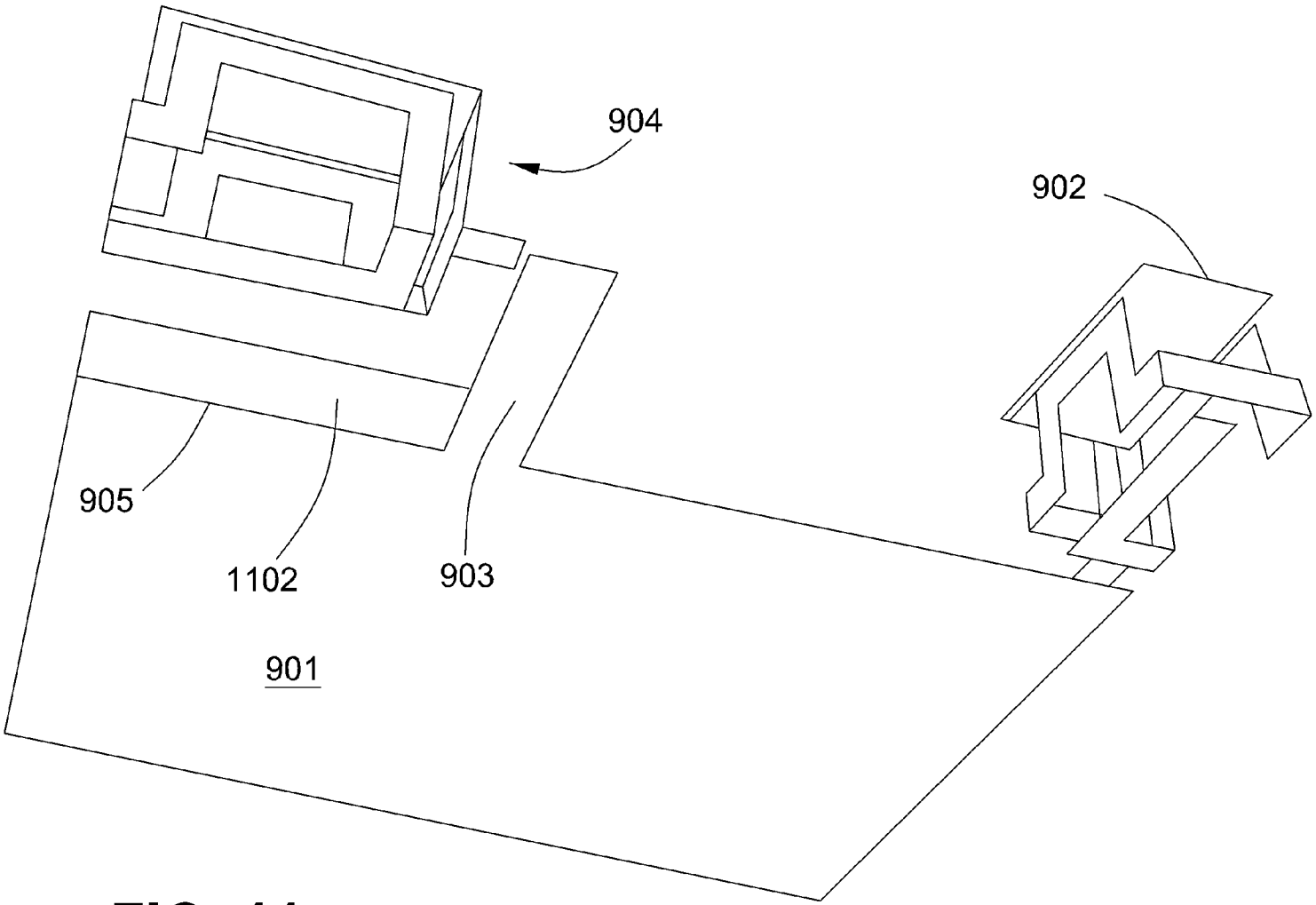
FIGS. 11*a-c* show schematic diagrams of various ground plane stub sizes for the two-port antenna of FIG. 9*a;*
Figure 11B:
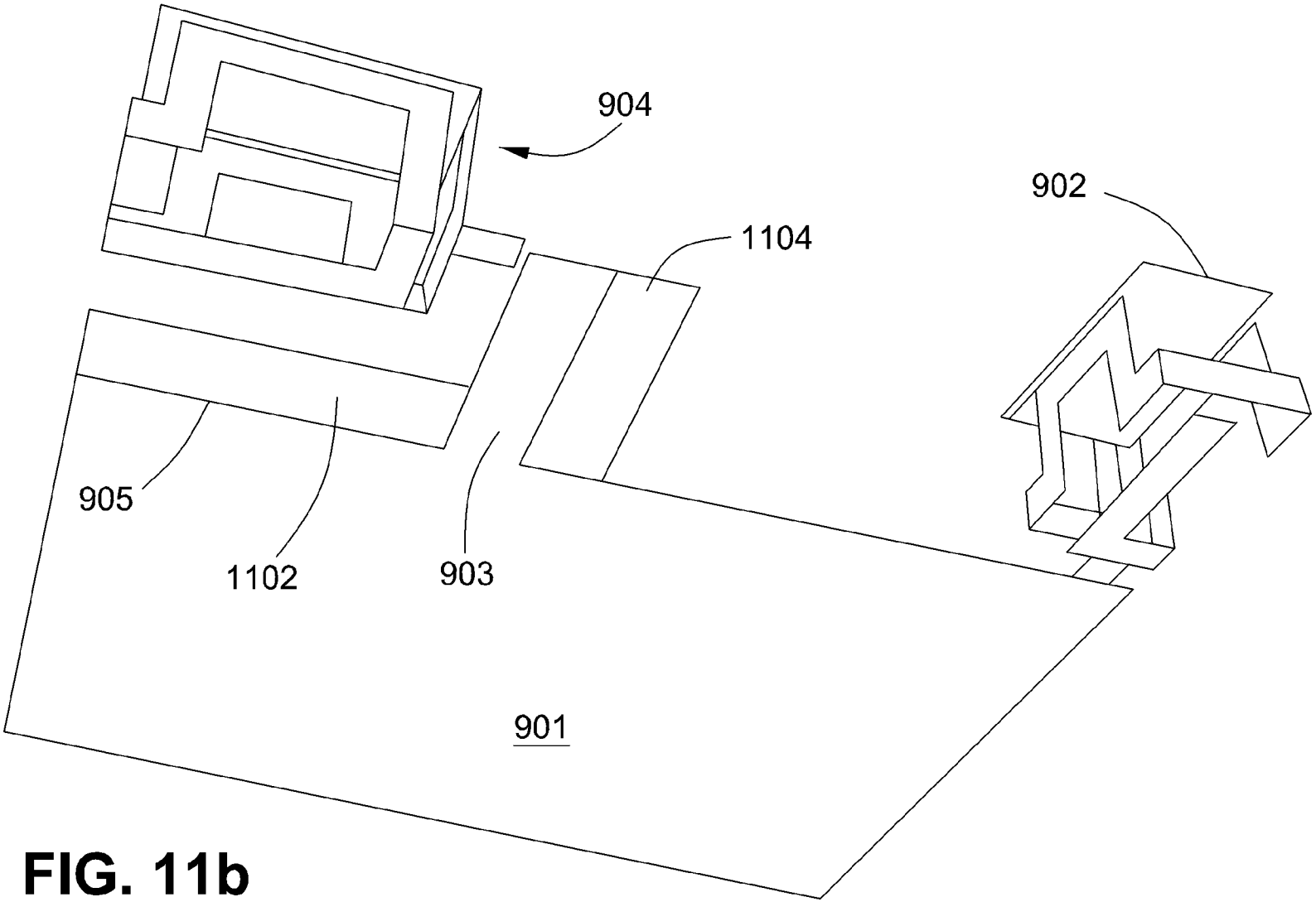
Figure 12A:
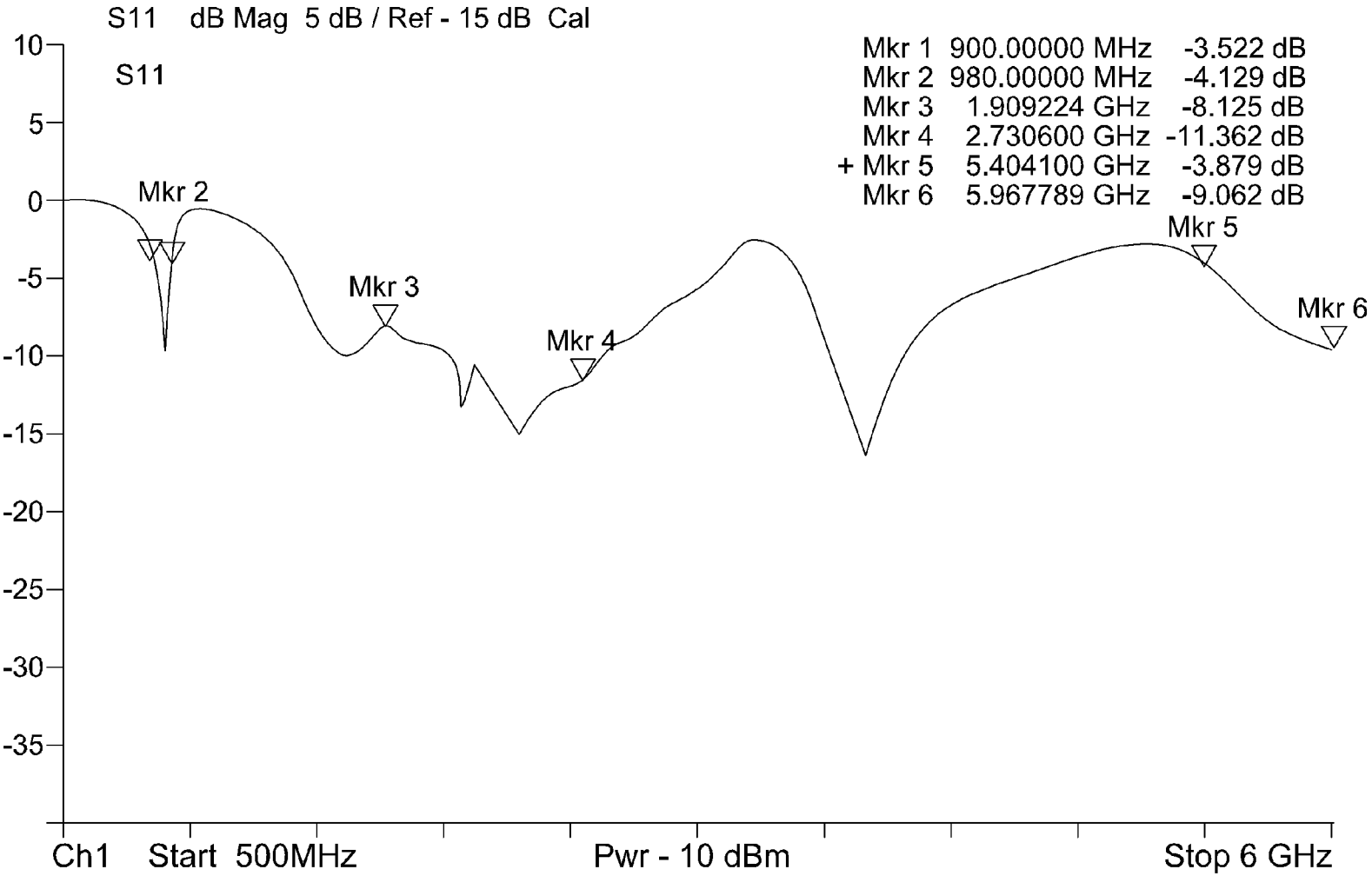
FIGS. 12*a-c* show plots of measured S parameters, for the antenna configuration of FIG. 11*a;*
Figure 12B:
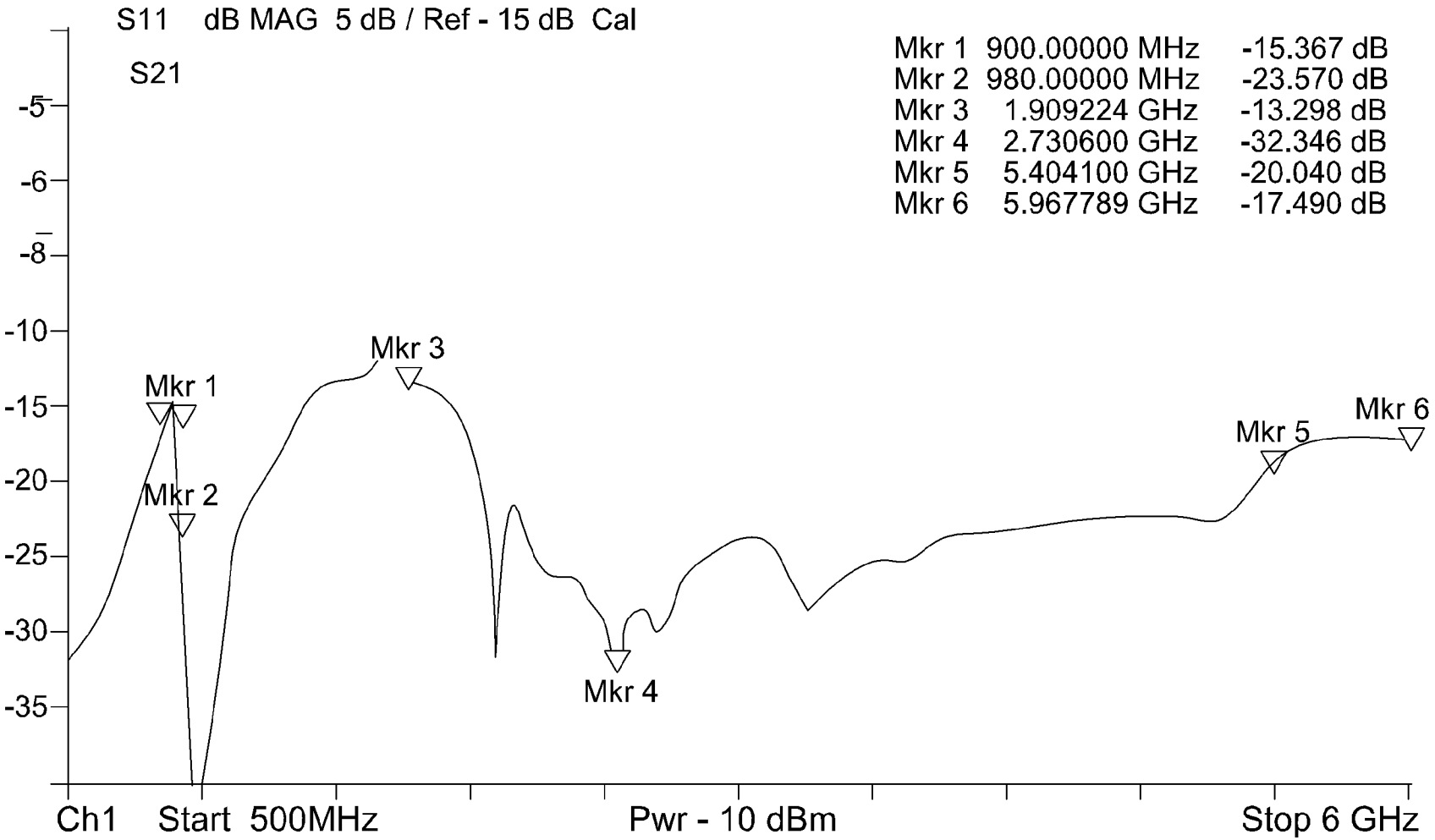
Figure 12C:
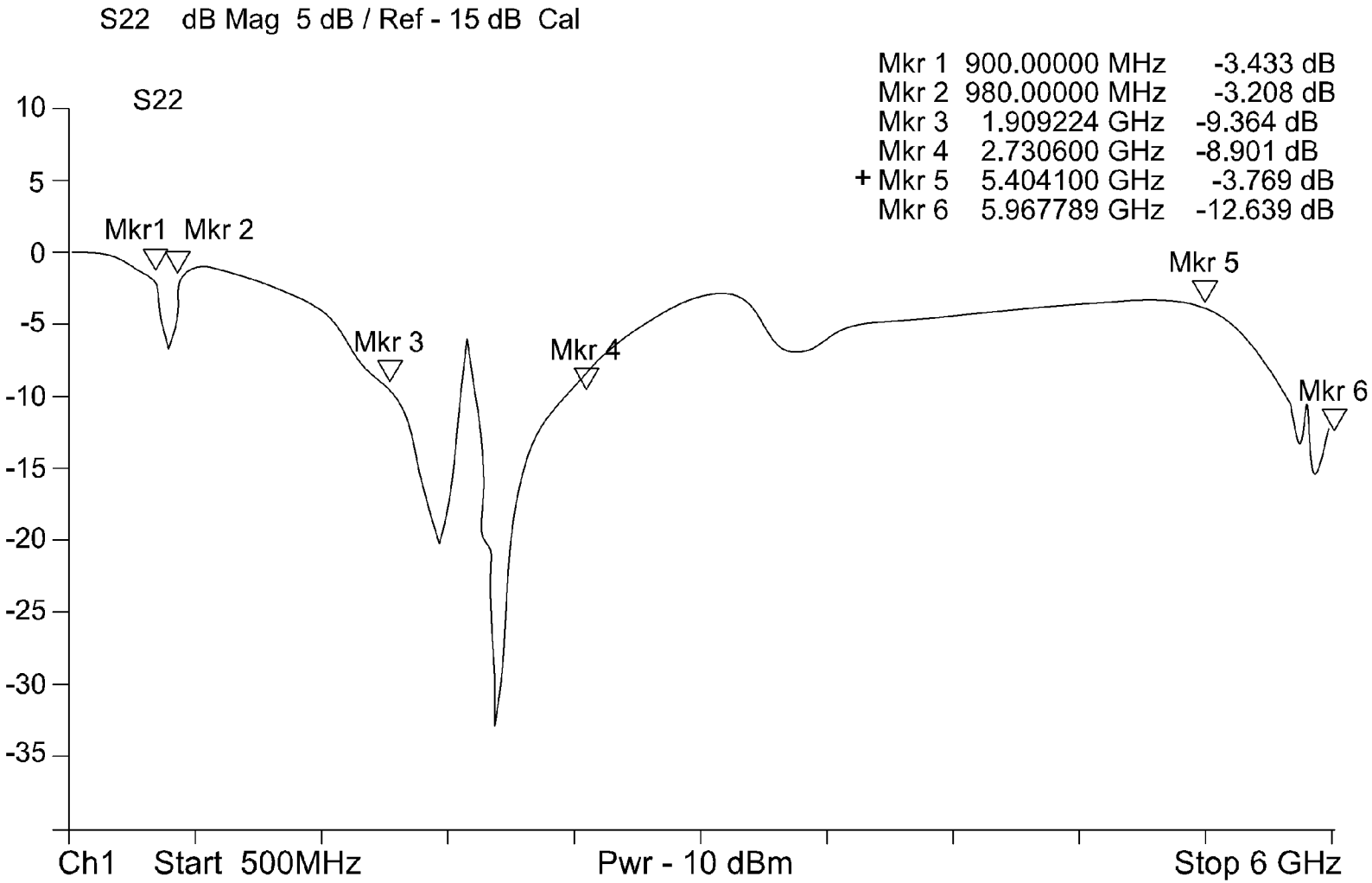

Varying a size and arrangement of stub sections, such as stub section 903, may change the response of the two-port antenna arrangement shown in FIGS. 9*a-c*. Referring to FIGS. 11*a-b* there is shown various stub sizes and arrangements for the two-port antenna 900. For example, as shown in FIG. 11*a*, a section 1102 is added along the edge 905 of the ground plane 901, to extend the ground plane under the second antenna 904. In an exemplary embodiment the section 1102 has a width of 5 mm and length of 17 mm and FIGS. 12*a-c* shown corresponding plots of measured S parameters (S11, S21 and S22, respectively), for the dual port antennas.

Figure 13A:
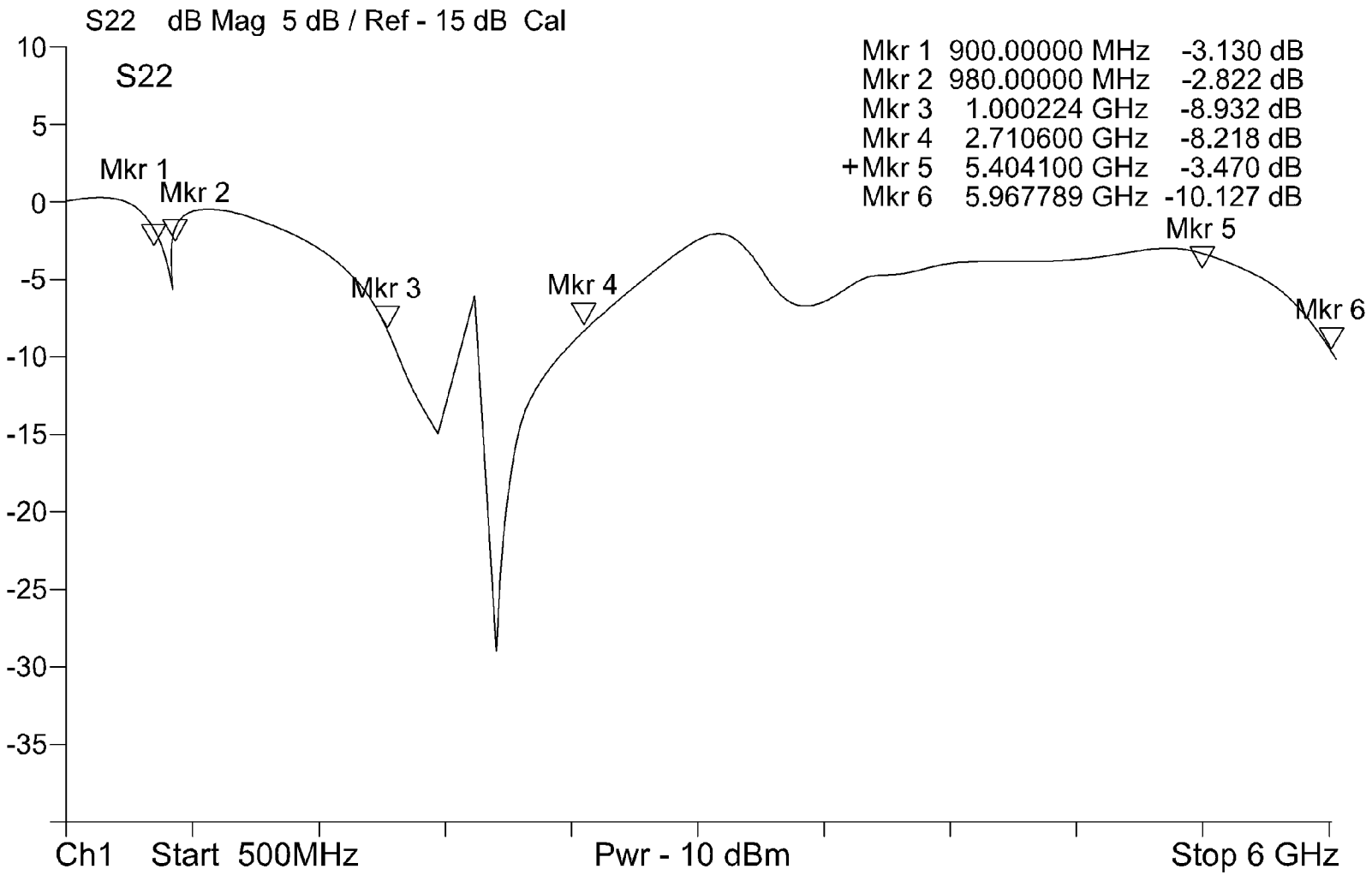
FIGS. 13*a-c* show plots of measured S parameters, for the antenna configuration of FIG. 11*b;*
Figure 13B:
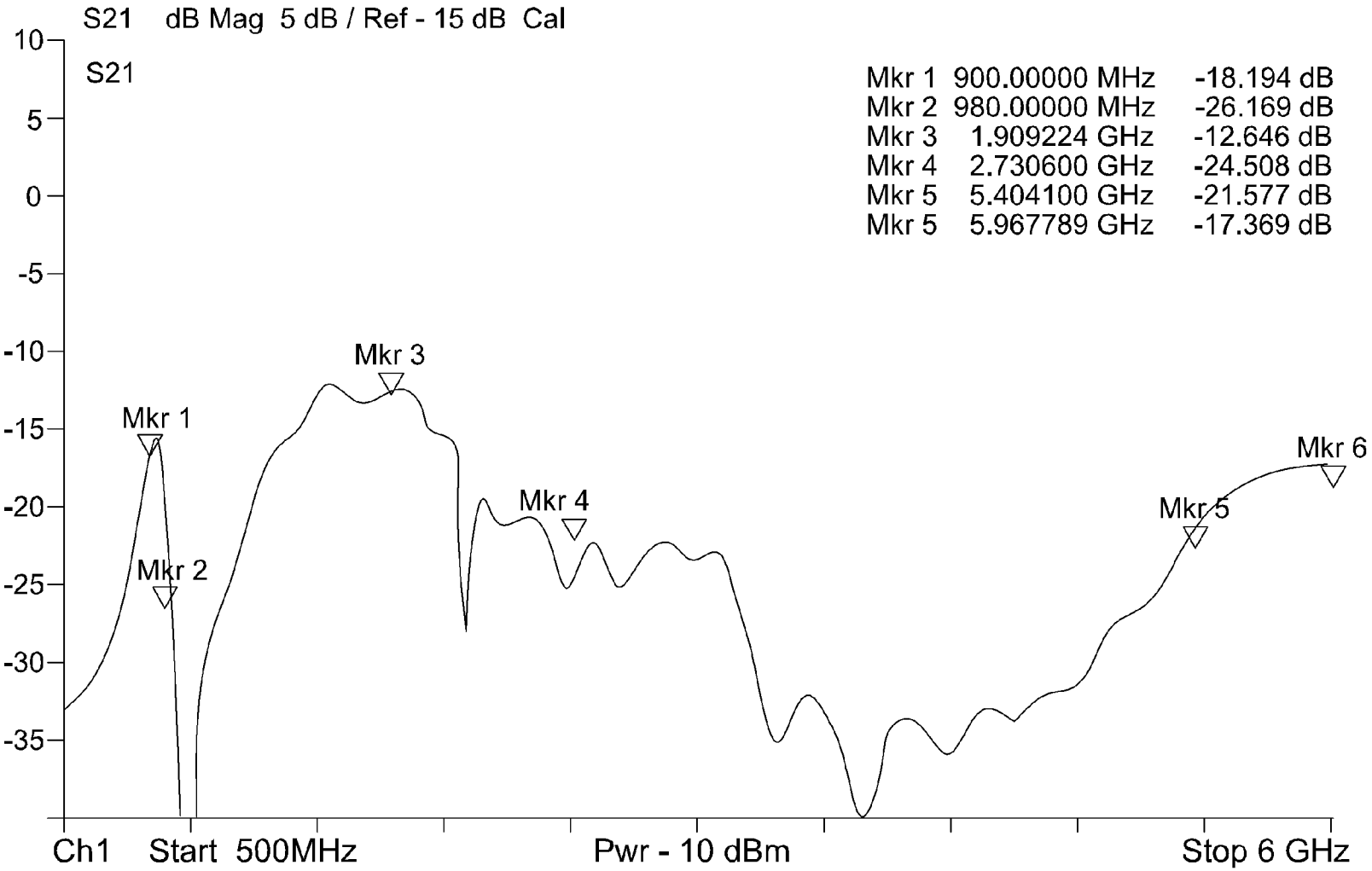
Figure 13C:
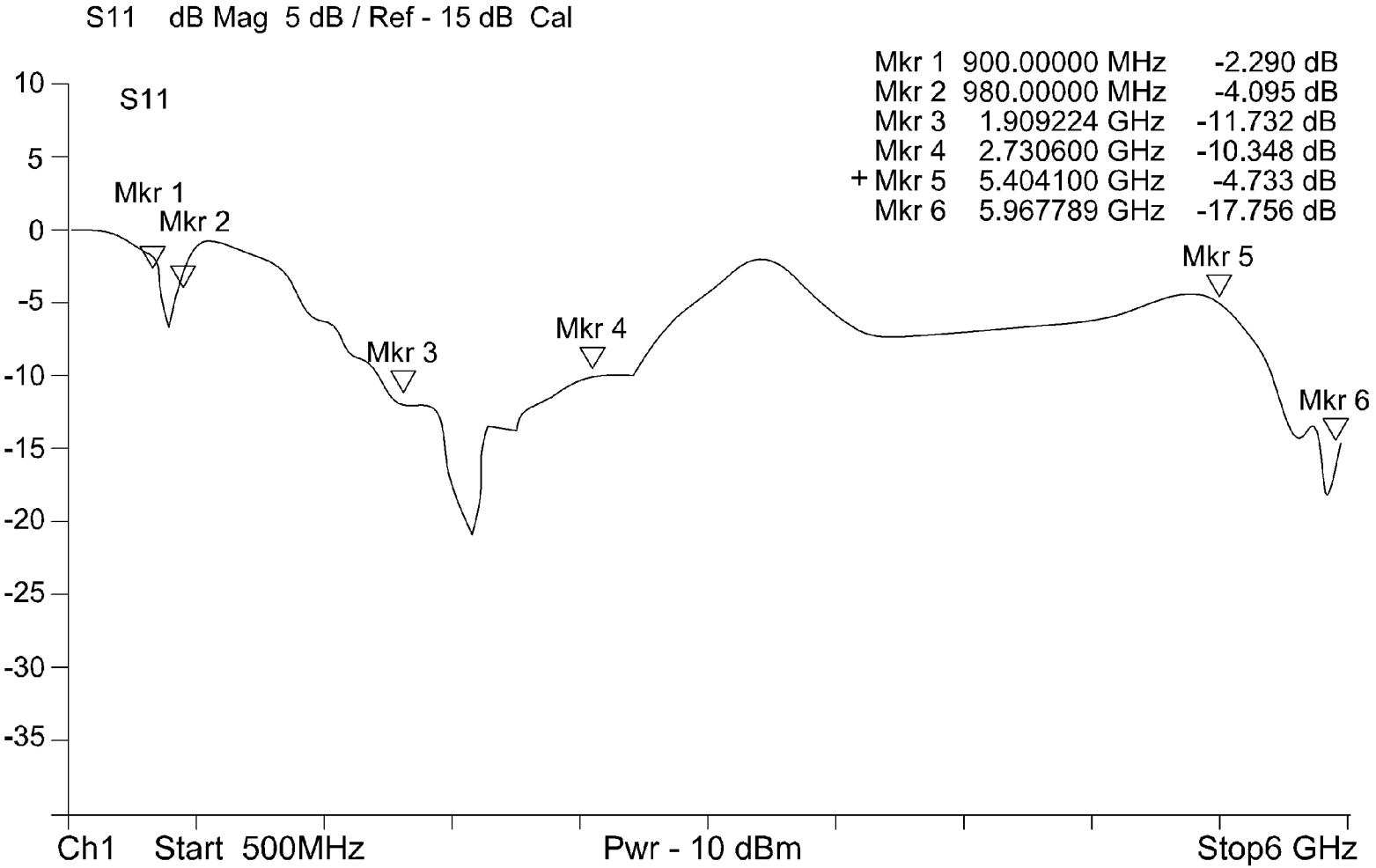

Similarly, FIG. 11*b* shows a further section 1104 added alongside one edge of the section 903 to extend the ground plane 901 between the antennas 902, 904. In an exemplary embodiment the section 1104 has a width of 10 mm and length of 17 mm and FIGS. 13*a-c* show corresponding plots of measured S parameters (S11, S21 and S22, respectively).

Figure 11C:
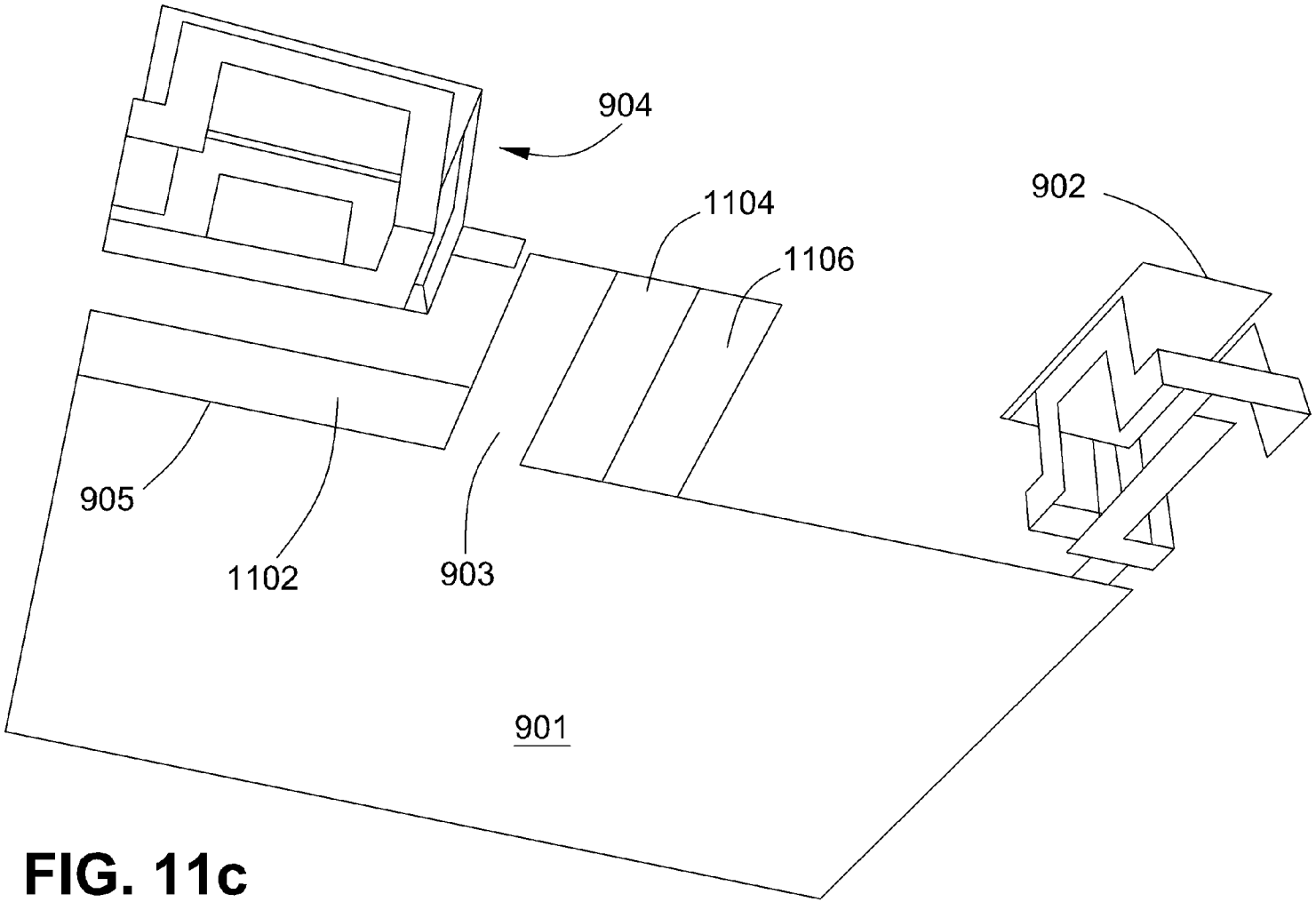
Figure 14A:
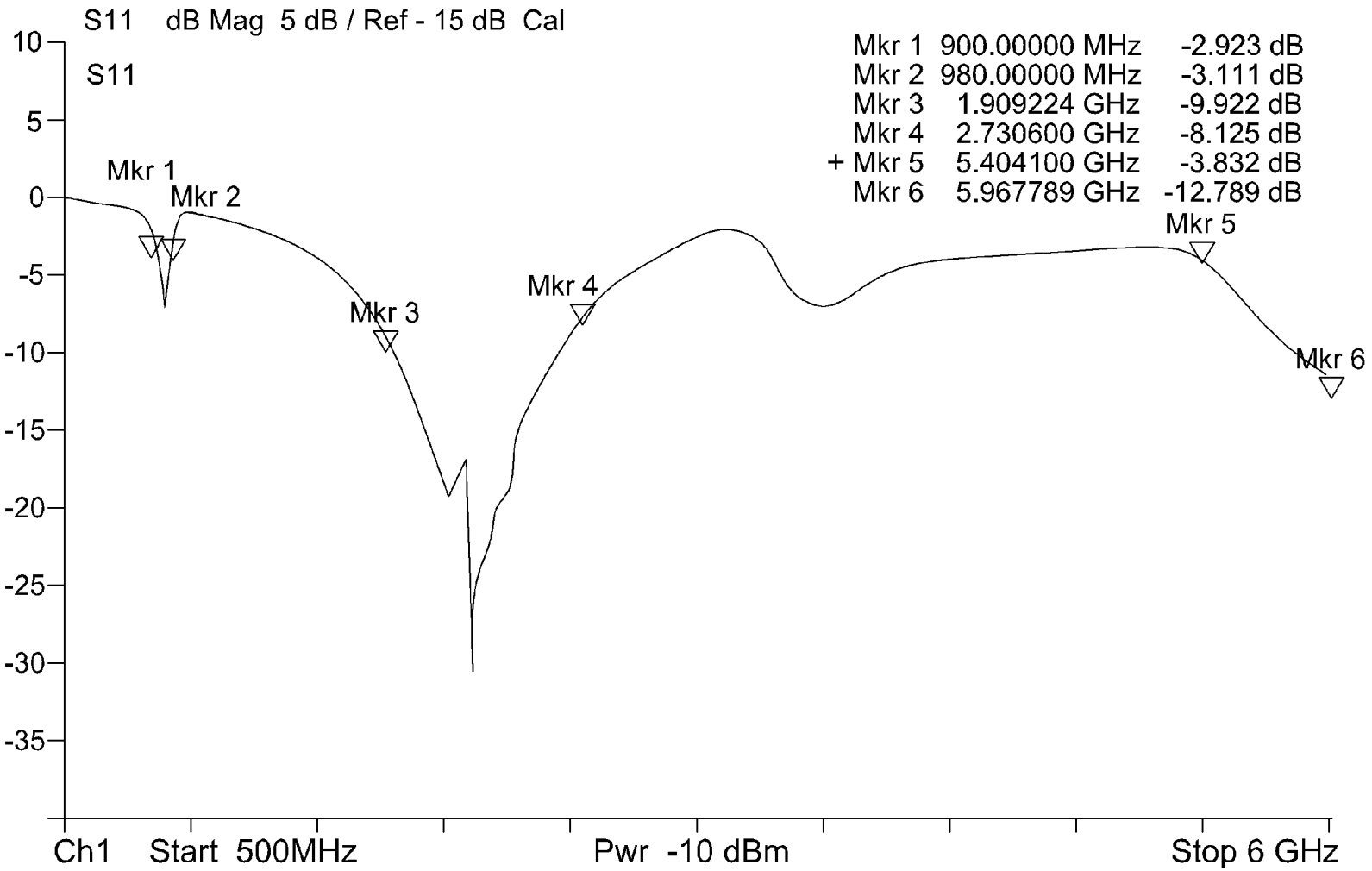
FIGS. 14*a-c* show plots of measured S parameters, for the antenna configuration of FIG. 11*c*.
Figure 14B:
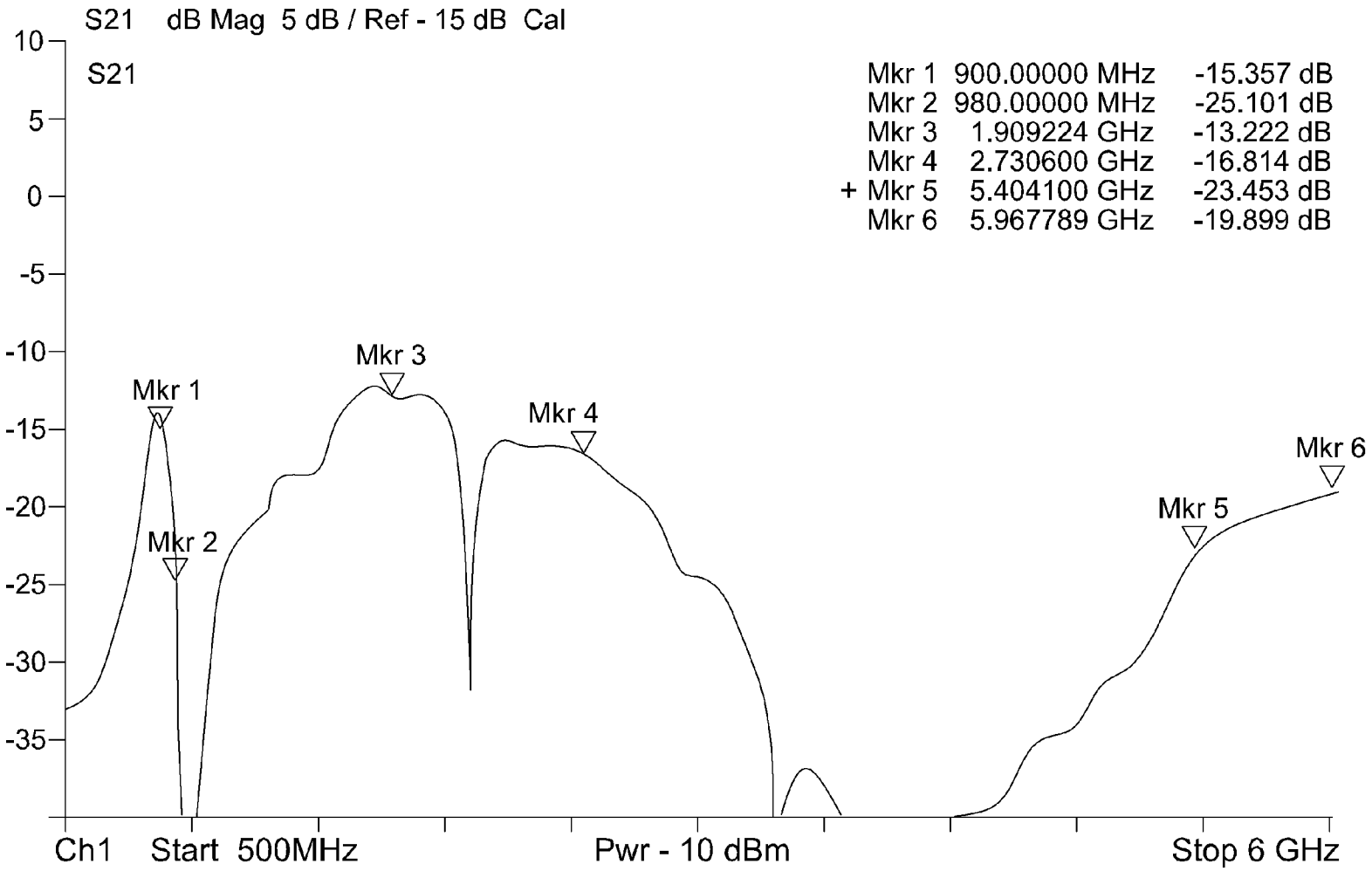
Figure 14C:
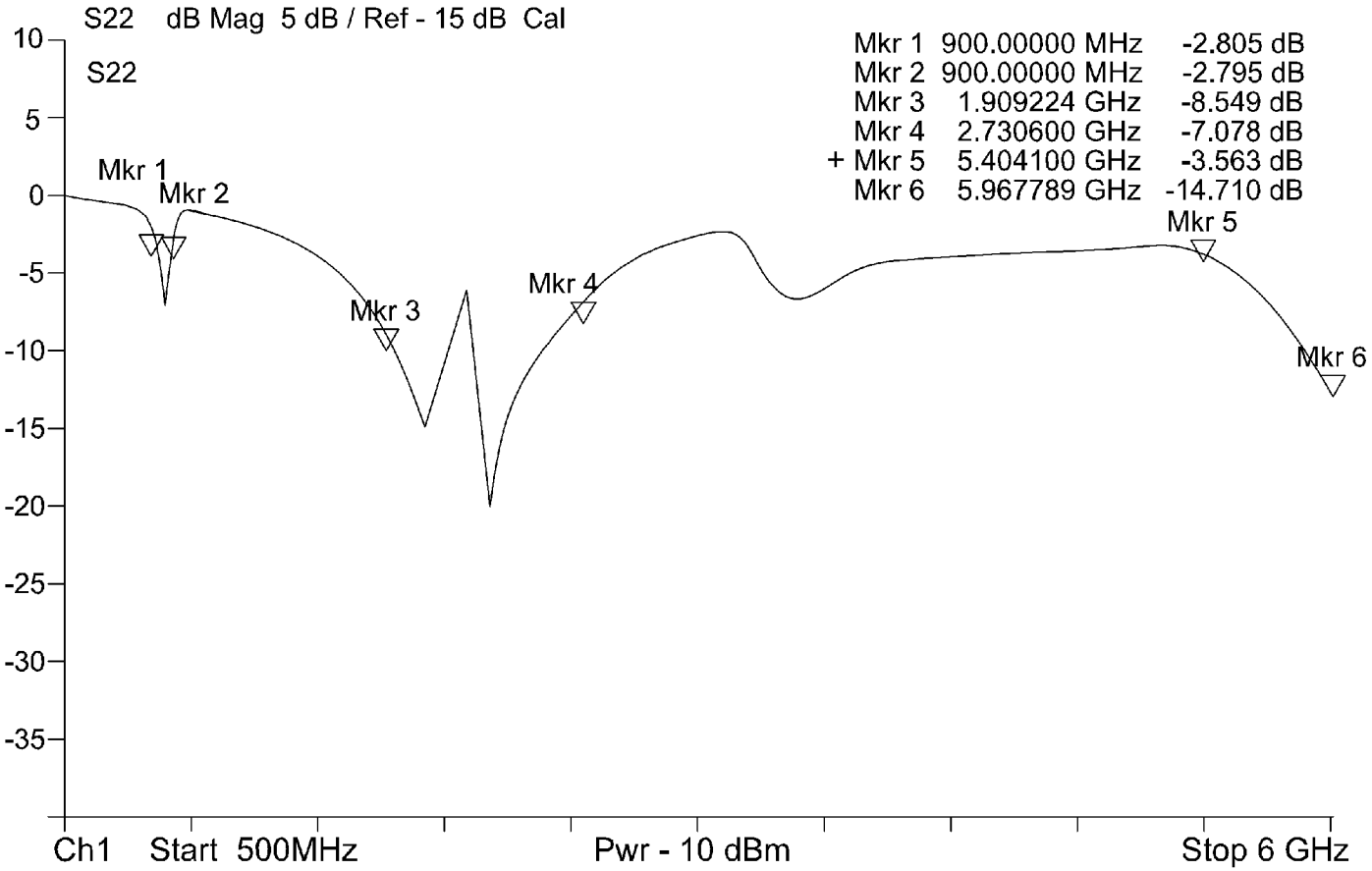

Still further, in FIG. 11*c* there is shown a section 1106 added alongside the section 1104 to extend the ground plane 901 further between the antennas 902, 904. In an exemplary embodiment the section 1106 has a width of 10 mm and length of 17 mm, adding a width of 20 mm to the section 903 and FIGS. 14*a-c* show corresponding plots of measured S parameters (S11, S21 and S22, respectively).

It may be seen from the S parameter plots in FIGS. 12-14 that the size of the stub, such as stub 903 affects the operating frequency and isolation of the antennas 902, 904. Thus the size of the stub may be varied in order to change the overall operating frequency of the dual antenna arrangement. Furthermore, this may be combined with varying the patch width d of each multi-band antenna to provide a greater degree of flexibility in the operating range of the dual antenna. Still further, because of the high mode isolation and low coupling between the antennas each antenna may be adjusted to operate in a particular frequency range without greatly affecting the other antenna. While the above embodiments have been described with respect to a dual antenna arrangement, arrangements with more than two antennas may also be implemented without departing from the scope of the present matter.

Exemplary components of a hand-held mobile wireless communications device 2200 in which one or more of the above-described folded monopole antennas 108 may be used are now described with reference to FIG. 15.

Figure 15:
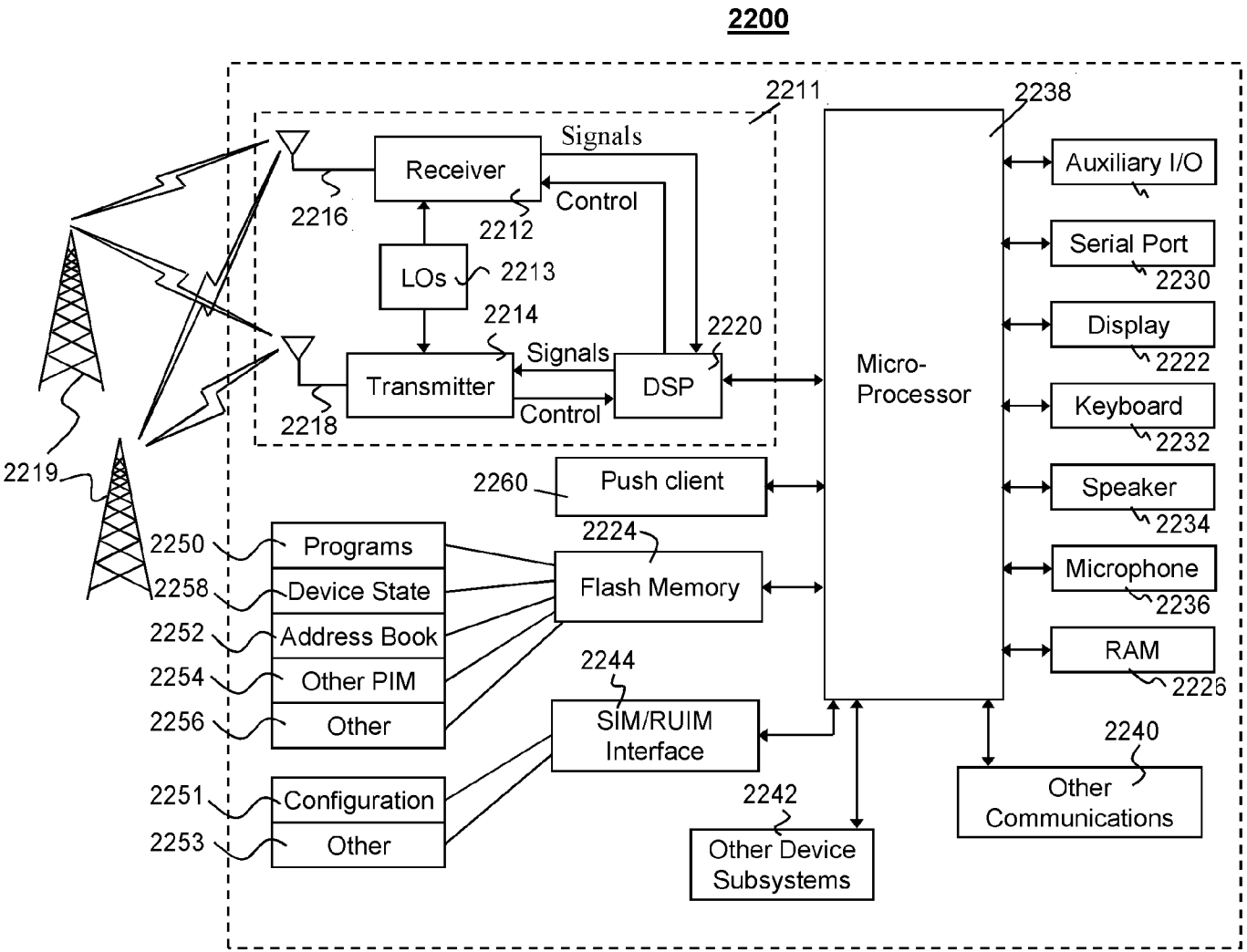
FIG. 15 is a schematic diagram of components of a handheld mobile wireless communications device.

The mobile device of FIG. 15 is not meant to be limiting, but merely provides an example of a mobile device that could be used in association with the present method and apparatus.

Mobile device 2200 is preferably a two-way wireless communication device having at least voice and data communication capabilities. Mobile device 2200 preferably has the capability to communicate with other computer systems on the Internet. Depending on the exact functionality provided, the mobile device may be referred to as a data messaging device, a two-way pager, a wireless e-mail device, a cellular telephone with data messaging capabilities, a wireless Internet appliance, or a data communication device, as examples.

Where mobile device 2200 is enabled for two-way communication, it will incorporate a communication subsystem 2211, including a receiver 2212 and a transmitter 2214, as well as associated components such as one or more, preferably embedded or internal, antenna elements 2216 and 2218, local oscillators (LOs) 2213, and a processing module such as a digital signal processor (DSP) 2220. As will be apparent to those skilled in the field of communications, the particular design of the communication subsystem 2211 will be dependent upon the communication network in which the device is intended to operate.

Network access requirements will also vary depending upon the type of network 2219. A GSM/UMTS device typically has a subscriber identity module (SIM) in order to get full service from the network. A cdma2000 device typically has such access credentials stored in it non-volatile memory or may use a removable user identity module (RUIM) in order to operate on a CDMA network. The SIM/RUIM interface 2244 is normally similar to a card-slot into which a SIM/RUIM card can be inserted and ejected like a diskette or PCMCIA card. The SIM/RUIM card can have approximately 64K of memory and hold many key configurations 2251, and other information 2253 such as identification, and subscriber related information.

When required network registration or activation procedures have been completed, mobile device 2200 may send and receive communication signals over the network 2219. As illustrated in FIG. 15, network 2219 can consist of multiple base stations communicating with the mobile device.

Signals received by antenna 2216 through communication network 2219 are input to receiver 2212, which may perform such common receiver functions as signal amplification, frequency down conversion, filtering, channel selection and the like, and in the example system shown in FIG. 15, analog to digital (ND) conversion. ND conversion of a received signal allows more complex communication functions such as demodulation and decoding to be performed in the DSP 2220. In a similar manner, signals to be transmitted are processed, including modulation and encoding for example, by the DSP 2220 and input to transmitter 2214 for digital to analog conversion, frequency up conversion, filtering, amplification and transmission over the communication network 2219 via antenna 2218. The DSP 2220 not only processes communication signals, but also provides for receiver and transmitter control. For example, the gains applied to communication signals in receiver 2212 and transmitter 2214 may be adaptively controlled through automatic gain control algorithms implemented in the DSP 2220.

Mobile device 2200 preferably includes a microprocessor 2238 which controls the overall operation of the device. Communication functions, including at least data and voice communications, are performed through communication subsystem 2211. Microprocessor 2238 also interacts with further device subsystems such as the display 2222, flash memory 2224, random access memory (RAM) 2226, auxiliary input/output (I/O) subsystems 2228, serial port 2230, two or more keyboards or keypads 2232, speaker 2234, microphone 2236, other communication subsystem 2240 such as a short-range communications subsystem and any other device subsystems generally designated as 2242. Serial port 2230 could include a USB port or other port known to those in the art.

Some of the subsystems shown in FIG. 15 perform communication-related functions, whereas other subsystems may provide "resident" or on-device functions. Notably, some subsystems, such as keyboard 2232 and display 2222, for example, may be used for both communication-related functions, such as entering a text message for transmission over a communication network, and device-resident functions such as a calculator or task list.

Operating system software used by the microprocessor 2238 is preferably stored in a persistent store such as flash memory 2224, which may instead be a read-only memory (ROM) or similar storage element (not shown). Those skilled in the art will appreciate that the operating system, specific device applications, or parts thereof, may be temporarily loaded into a volatile memory such as RAM 2226. Received communication signals may also be stored in RAM 2226.

As shown, flash memory 2224 can be segregated into different areas for both computer programs 2258 and program data storage 2250, 2252, 2254 and 2256. These different storage types indicate that each program can allocate a portion of flash memory 2224 for their own data storage requirements. Microprocessor 2238, in addition to its operating system functions, preferably enables execution of software applications on the mobile device. A predetermined set of applications that control basic operations, including at least data and voice communication applications for example, will normally be installed on mobile device 2200 during manufacturing. Other applications could be installed subsequently or dynamically.

A preferred software application may be a personal information manager (PIM) application having the ability to organize and manage data items relating to the user of the mobile device such as, but not limited to, e-mail, calendar events, voice mails, appointments, and task items. Naturally, one or more memory stores would be available on the mobile device to facilitate storage of PIM data items. Such PIM application would preferably have the ability to send and receive data items, via the wireless network 2219. In a preferred embodiment, the PIM data items are seamlessly integrated, synchronized and updated, via the wireless network 2219, with the mobile device user's corresponding data items stored or associated with a host computer system. Further applications may also be loaded onto the mobile device 2200 through the network 2219, an auxiliary I/O subsystem 2228, serial port 2230, short-range communications subsystem 2240 or any other suitable subsystem 2242, and installed by a user in the RAM 2226 or preferably a non-volatile store (not shown) for execution by the microprocessor 2238. Such flexibility in application installation increases the functionality of the device and may provide enhanced on-device functions, communication-related functions, or both. For example, secure communication applications may enable electronic commerce functions and other such financial transactions to be performed using the mobile device 2200.

In a data communication mode, a received signal such as a text message or web page download will be processed by the communication subsystem 2211 and input to the microprocessor 2238, which preferably further processes the received signal for output to the display 2222, or alternatively to an auxiliary I/O device 2228.

A user of mobile device 2200 may also compose data items such as email messages for example, using the keyboard 2232, which is preferably a complete alphanumeric keyboard or telephone-type keypad, in conjunction with the display 2222 and possibly an auxiliary I/O device 2228. Such composed items may then be transmitted over a communication network through the communication subsystem 2211.

For voice communications, overall operation of mobile device 2200 is similar, except that received signals would preferably be output to a speaker 2234 and a microphone 2236 would generate signals for transmission. Alternative voice or audio I/O subsystems, such as a voice message recording subsystem, may also be implemented on mobile device 2200. Although voice or audio signal output is preferably accomplished primarily through the speaker 2234, display 2222 may also be used to provide an indication of the identity of a calling party, the duration of a voice call, or other voice call related information for example.

Serial port 2230 in FIG. 15 would normally be implemented in a personal digital assistant (PDA)-type mobile device for which synchronization with a user's desktop computer (not shown) may be desirable, but is an optional device component. Such a port 2230 would enable a user to set preferences through an external device or software application and would extend the capabilities of mobile device 2200 by providing for information or software downloads to mobile device 2200 other than through a wireless communication network. The alternate download path may for example be used to load an encryption key onto the device through a direct and thus reliable and trusted connection to thereby enable secure device communication. As will be appreciated by those skilled in the art, serial port 2230 can further be used to connect the mobile device to a computer to act as a modem.

Other communications subsystems 2240, such as a short-range communications subsystem, is a further optional component which may provide for communication between mobile device 2200 and different systems or devices, which need not necessarily be similar devices. For example, the subsystem 2240 may include an infrared device and associated circuits and components or a Bluetooth™ communication module to provide for communication with similarly enabled systems and devices.

The embodiments described herein are examples of structures, systems or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein.

The invention claimed is:

1. A multi-band antenna comprising:

a dielectric substrate;

a ground plane formed on a first area of the dielectric substrate;

a radiation part formed of a continuous metallic trace arranged in a second area of the dielectric substrate where the ground surface is not formed, a feed section continuous with the metallic trace and having one end connected to the radiation part and an opposite end disposed near an edge of the ground plane for forming a feed point for connection to a connector;

the radiation part having a pair of monopole antenna elements formed of the conductive metallic trace; a first monopole antenna element for radiating at a first resonant frequency, and a second monopole antenna element for radiating at a second resonant frequency and the conductive metallic traces having a uniform width and being folded to form a three dimensional structure; and a single patch element, the single patch element extending from said second monopole, the single patch element solely forming one side of the three dimensional structure and the first monopole forming a plurality of other sides of the three dimensional structure, wherein the single patch element has a width that extends the uniform width of said second monopole, wherein the width of said patch element adjusts the resonant frequency of the second monopole independently of the resonant frequency of the first monopole.

2. The antenna as defined in claim 1, including a dielectric shell defining a generally rectangular shape having opposing top and bottom faces, opposing first and second end faces and opposing first and second side faces, the bottom face of said dielectric shell positioned in said second area of said substrate and said three dimensional structure of said metallic trace being formed around said dielectric shell.

3. The antenna as defined in claim 2, said patch element formed on the top surface of said shell.

4. The antenna as defined in claim 2, said patch element formed on the bottom surface of said shell.

5. The antenna as defined in claim 1, including a plurality of said multi-band antennas arranged in the second area of the dielectric substrate.

6. The antenna as defined in claim 1, further comprising a dielectric support defining a generally regular shape having opposing top and bottom faces, opposing first and second end faces and opposing first and second side faces, the bottom face of said dielectric support positioned in said second area of said substrate and said three dimensional structure of said metallic trace being supported by said dielectric support.

7. The antenna as defined in claim 6, said patch element formed on the top surface of said dielectric support.

8. The antenna as defined in claim 6, said patch element formed on the bottom surface of said dielectric support.

9. The antenna as defined in claim 1, wherein the first monopole forms five sides of the three dimensional structure.

10. A mobile wireless communication device comprising:

a housing;

a dielectric substrate carried within said housing;

wireless communication circuitry carried by said substrate; and a multi-band antenna coupled to said wireless communication circuitry and comprising a ground plane formed on a first area of the dielectric substrate;

a radiation part formed of a continuous metallic trace arranged in a second area of the dielectric substrate where the ground surface is not formed, a feed section continuous with the metallic trace and having one end connected to the radiation part and an opposite end disposed near an edge of the ground plane for forming a feed point for direct connection to a feed connector; and the radiation part having a pair of monopole antenna elements formed of the conductive metallic trace; a first of the monopole antenna elements for radiating at a first resonant frequency, and a second of the monopole antenna elements for radiating at a second resonant frequency and the conductive metallic traces having a uniform width and being folded to form a three dimensional structure; and a single patch element, the single patch element extending from said second monopole, the single patch element solely forming one side of the three dimensional structure and the first monopole forming a plurality of other sides of the three dimensional structure, wherein the single patch element has a width that extends the uniform width of said second monopole, wherein the width of said patch element adjusts the resonant frequency of the second monopole independently of the resonant frequency of the first monopole.

11. The mobile wireless communication device of claim 10, including a dielectric shell defining a generally rectangular shape having opposing top and bottom faces, opposing first and second end faces and opposing first and second side faces, the bottom face of said dielectric shell positioned on said second area of said substrate and said three dimensional structure of said metallic trace being formed around said dielectric shell.

12. The mobile wireless communication device of claim 10, said wireless communication circuitry comprises a cellular transceiver.

13. The mobile wireless communication device as defined in claim 11, said patch element formed on the top surface of said shell.

14. The mobile wireless communication device as defined in claim 11, said patch element formed on the bottom surface of said shell.

15. The mobile wireless communication device as defined in claim 10 including a plurality of said multi-band antennas arranged in the second area of the dielectric substrate.

16. The mobile wireless communication device as defined in claim 15, including a stub section for extending the ground plane into the second area, the stub size to determine an operating frequency and isolation of the multi-band antennas.

17. The antenna as defined in claim 10, wherein the first monopole forms five sides of the three dimensional structure.

* * * * *